US006739714B2

(12) United States Patent
Saijo

(10) Patent No.: US 6,739,714 B2
(45) Date of Patent: May 25, 2004

(54) IMAGE FORMATION APPARATUS

(75) Inventor: Yasutsugu Saijo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 60 days.

(21) Appl. No.: 09/996,898

(22) Filed: Nov. 30, 2001

(65) Prior Publication Data

US 2002/0054198 A1 May 9, 2002

Related U.S. Application Data

(62) Division of application No. 08/569,859, filed on Dec. 8, 1995, now Pat. No. 6,341,858.

(30) Foreign Application Priority Data

| | | |
|---|---|---|
| Dec. 9, 1994 | (JP) | 6-306417 |
| Feb. 13, 1995 | (JP) | 7-23571 |
| Jul. 18, 1995 | (JP) | 7-203901 |
| Nov. 16, 1995 | (JP) | 7-298525 |
| Dec. 1, 1995 | (JP) | 7-314405 |

(51) Int. Cl.[7] ..... B41J 2/17; B41J 2/01
(52) U.S. Cl. ..... 347/96; 347/101; 347/103
(58) Field of Search ..... 347/96, 101, 103, 347/98

(56) References Cited

U.S. PATENT DOCUMENTS

| | | | | |
|---|---|---|---|---|
| 4,382,262 A | * | 5/1983 | Savit | 347/96 |
| 4,538,160 A | | 8/1985 | Uchiyama | 347/101 |
| 4,599,627 A | | 7/1986 | Vollert | 347/20 |
| 4,836,852 A | | 6/1989 | Knirsch et al. | 106/31.33 |
| 5,462,590 A | * | 10/1995 | Yui et al. | 106/31.43 |
| 5,635,969 A | | 6/1997 | Allen | 347/96 |
| 5,646,653 A | | 7/1997 | Fujioka et al. | 347/37 |
| 6,161,928 A | * | 12/2000 | Morikawa et al. | 347/96 |

FOREIGN PATENT DOCUMENTS

| | | |
|---|---|---|
| DE | 3434875 | 10/1985 |
| EP | 534634 | 3/1993 |
| JP | 61-75870 | 4/1986 |
| JP | 63-299971 | 12/1988 |
| JP | 5-202328 | 8/1993 |

* cited by examiner

*Primary Examiner*—Michael S. Brooke
(74) *Attorney, Agent, or Firm*—Fitzpatrick, Cella, Harper & Scinto

(57) ABSTRACT

An image forming apparatus includes a head mounting portion for mounting an ink jet recording head for discharging ink liquid having a coloring material from an ink discharge port. Also included is a process liquid storing member for storing a process liquid for condensing the coloring material in the ink liquid. A process liquid supply roller is arranged immersibly in the process liquid stored in the process liquid storing member. The process liquid supply roller does not contact a recording surface of the recording medium. A process liquid coating roller coats the recording surface with the process liquid supplied through the process liquid supply roller, the process liquid coating roller being provided so that a peripheral surface of the process liquid coating roller is contactable with the recording surface upstream of a conveyance direction of the recording medium with respect to the head mounting portion.

7 Claims, 21 Drawing Sheets

IMAGE FORMATION APPARATUS

This application is a division of application Ser. No. 08/569,859, filed Dec. 8, 1995, now U.S. Pat. No. 6,341,858.

BACKGROUND OF THE INVENTION

1. Field of the Invention

The present invention relates to an image formation apparatus. More particularly, the invention relates to an image formation apparatus preferably suitable for use of an ink jet recording method. Here, in this respect, recording includes the application of ink (printing) or the like for all the ink supporting members to receive it, such as cloths, threads, papers, sheet materials. The recording apparatus includes every kind of information processing apparatus or printer serving as the output equipment thereof. The present invention is applicable to recording by use of such apparatuses.

2. Related Background Art

The ink jet recording method is to cause droplets of recording liquid to fly and apply them to paper or other recording media for recording.

Generally, however, the main component of ink used for the conventional ink jet recording is water. It also contains water soluble high-boiling point solvents, such as glycol, to prevent ink from being dried or clogging of discharge ports, among other purposes. Therefore, when recording is performed on an ordinary paper using such ink, a sufficient fixation is not obtainable in some cases, and uniform images are not formed sometimes, either, presumably due to uneven distribution of loading material and sizing agent on the surface of a recording paper. Particularly when it is attempted to form color images, colors often spread on the boundaries of images of different colors or mixed unevenly because ink of plural kinds of colors are superposed one after another before each of them is fixed on the paper, thus making the provision of satisfactory images impossible.

Therefore, with a view to solving such problems, there is proposed a method, in which before recording ink is discharged, liquid is applied to a recording medium as a processing liquid that makes a good formation of images possible.

For example, a method is disclosed in Japanese Patent Laid-Open Application No. 5-202328, wherein there are used an ink component containing at least chemical dyeing agent having at least one carboxyl group, and a polyvalent metallic salt solvent, and then, the ink component is used to obtain good images on a recording medium subsequent to having applied the polyvalent metallic salt to the recording medium.

Also, in Japanese Patent Laid-Open Application No. 61-75870, there are disclosed an image formation method, a processing liquid, and an ink component used therefor in order to obtain images in good condition.

Then, a method is disclosed in the embodiments of patents filed with the Japanese Patent Laid-Open Application Nos. 5-202328 and 61-75870 to apply the processing liquid to a recording medium by use of a roller before recording is performed by use of an ink jet recording head.

Both of the method and technique thus disclosed are to use an application roller having a length more than the width of a recording medium for the application of the processing liquid to the recording medium in its width direction at a time.

In this method, that is, an application roller having a length more than the width of a recording medium is used for applying the processing liquid in the width direction of the recording medium at a time, the application roller is interlocked with the feeding operation of the recording medium to carry out an overall application of the processing liquid. As a result, although this method is effective, there are still encountered the problems given below.

(1) The application of processing liquid is performed even when a recording medium is not pinched by a pair of rollers. Therefore, the processing liquid is carried on all over the rollers, and when the recording medium is pinched by the rollers, the processing liquid is also applied around to the backside of the recording medium. Hence, not only the processing liquid is used wastefully, but also, it is transferred again to the platen, causing stains together with ink mist.

(2) The location where the processing liquid is applied and the portion where the image data are actually recorded by use of ink are physically apart from each other. As a result, it takes time before the image data are recorded after the processing liquid has been applied. Therefore, the processing liquid is caused to be overly permeated or volatilized, and the degradation of image quality ensues depending on the conformity of the processing liquid and ink containing coloring materials.

(3) When an image is formed by use of ink discharged from a recording head on a jointed portion of processing liquid on the surface of the recording medium (paper), the elapsed time becomes different since the processing liquid has been applied to the locations before and after such joint portion thereof. Therefore, despite ink is discharged simultaneously on the recording medium in the locations before and after such jointed portion, the degrees of permeation of the processing liquid differ before and after the jointed portion on the recording medium. As a result, there occurs difference in the surface density of the effective components that cohere the coloring materials contained in ink on the surface of the recording medium, thus causing the degrees of cohesion of such materials to vary. Consequently, unevenness is brought about in the images to be formed.

(4) The length of the roller should be made more than the width of a recording medium. This presents itself one factor that may hinder making the apparatus smaller.

Also, there are the following problems encountered in using the method, in which the processing liquid is being applied to a recording medium continuously by means of roller or the like that is in contact with the recording medium:

(1) If the processing liquid is applied, preceding ink discharges, to an OHP sheet or the so-called coated paper, that is, a recording medium having an ink receiving layer already formed on its base material, the recorded image is often degraded due to the influence of excessive amount of processing liquid because such medium is prepared in anticipation of the event that ink is directly impacted on the aforesaid ink receiving layer.

(2) When idle rotation is performed to feed or exhaust a recording medium, an excessive amount of processing liquid is applied to the platen unit arranged below the processing liquid application unit, when the processing liquid is applied by use of this unit without presence of any recording medium. As a result, the platen is stained by the adhesion of ink mist, and then, such stain is transferred again to the processing liquid application unit, thus inviting the adhesion of stains to the recording medium or the volume of processing liquid becomes short of the amount good enough to be applied to the anticipated sheet numbers of recording medium.

(3) The apparatus is used as a printer output of a computer or the like, and particularly when a large quantity of data should be transferred for the formation of highly precise color images, for example, there often occurs an interruption of image formation for a long time despite it is still in process because of such data transfer from the computer. Then, if means for applying processing liquid is left intact during such period of interruption, the processing liquid is applied to the recording medium more than necessary to cause the recorded image to be disturbed.

(4) When any defective feed of a recording medium such as the so-called jamming takes place, it is difficult to remove the recording medium if means for applying processing liquid should be left in contact with the recording medium, and the processing liquid is applied wastefully eventually.

Also, the method, in which a processing liquid retainer is provided separately from a recording ink retainer for the intended use, the problems are encountered with respect to refilling the processing liquid as given below.

In other words, even if recorded images become degraded due to the short supply of processing liquid, it is often difficult for the operator to grasp such cause of quality degradation, depending on the contents of the recorded images, because the processing liquid is essentially colorless and transparent in many cases. To enable him to know such causes brought about by the shortage of processing liquid, there is a need for the provision of independent means dedicated to serving such purpose for sensing the remains of processing liquid. The provision of a means of the kind naturally hinders making the apparatus smaller and its operation simpler to let the operator understand it easily.

SUMMARY OF THE INVENTION

The present invention is designed to solve the problems described above. It is an object of the invention to provide an image formation apparatus capable of obtaining high quality images with an enhanced formation process of inked images adhering to a recording medium to which processing liquid has been applied.

It is another object of the invention to provide an image formation apparatus having application means for applying processing liquid, while keeping such means in contact with a recording medium, the apparatus being arranged to apply the processing liquid only in a required quantity efficiently, and also, to avoid any hindrance that may result in making the apparatus smaller.

It is still another object of the invention to provide an image formation method and an apparatus using such method to make it possible to apply processing liquid in an appropriate quantity as required.

It is a further object of the invention to provide an image formation apparatus capable of obtaining uniform quality of recorded images without any unevenness in them by preventing the jointed portion of applied processing liquid from being placed on the area for an image to be recorded on the surface of a recording medium even when the degrees of permeation of processing liquid differ on the recording medium due to the difference in the elapsed time since the processing liquid has been applied to the locations before and after such jointed portion of the applied processing liquid on the surface of the recording medium, thus making the surface density of the effective components evenly formed for cohering the coloring materials in ink on the recording medium, as well as for regulating the degrees of the cohesion of coloring materials.

It is still a further object of the invention to provide an image formation apparatus capable of obtaining uniform images without any unevenness in them by preventing the jointed portion of processing liquid from being placed on the area of an image to be recorded on the surface of a recording medium even when the difference takes place in the surface density of the processing liquid due to the difference in the elapsed time since the processing liquid has been applied to the locations before and after such jointed portion of the applied processing liquid, thus making the surface density of effective components evenly formed for cohering the coloring materials in ink on the recording medium, as well as for regulating the degrees of the cohesion of the coloring materials.

It is another object of the invention to provide an image formation apparatus capable of securing processing liquid in a quantity sufficient enough at all the time so as to prevent the quality of recorded images from being degraded.

It is still another object of the invention to provide an image formation apparatus, including a carriage for moving an ink jet recording head relatively with respect to a recording medium to discharge ink containing coloring materials from the ink discharge ports; processing liquid application means for applying to the recording medium the processing liquid that coheres the coloring materials in ink, this processing liquid application means being arranged to be in contact with the recording medium and apply the processing liquid to the recording medium before ink to be discharged from the recording head of the ink jet recording head; here, the processing liquid application means being mounted on the aforesaid carriage.

It is still another object of the invention to provide an image formation apparatus that forms images on a recording medium by discharging ink containing coloring materials onto the recording medium, including processing liquid application means for applying the processing liquid that coheres the coloring materials in ink to a recording medium, while being in contact therewith before the ink is discharged onto the recording medium; and means for switching over modes for selectively setting the recording medium and processing liquid application means to be in contact with or apart from each other.

It is an object of the invention to provide a method for forming images using processing liquid application means for applying the processing liquid that coheres the coloring materials in ink to a recording medium, while being in contact therewith, before the ink is discharged onto the recording medium, including the step of selectively setting the recording medium and processing liquid application means to be in contact with or apart from each other.

It is another object of the invention to provide an image formation apparatus using an ink jet recording head for recording by discharging ink from the discharge ports onto a recording medium, including processing liquid supply means for supplying the processing liquid that coheres the coloring materials in ink; processing liquid application means for applying the processing liquid to an area of the recording medium before images to be recorded on it, here, the distance between the discharge port of the discharge port array on the uppermost stream side in the feeding direction of the recording medium, and the application point of the processing liquid application means to the recording medium being set at integral times the feeding pitch of the recording medium.

It is still another object of the invention to provide an image formation apparatus using an ink jet recording head for recording by discharging ink from the discharge ports onto a recording medium, including processing liquid supply means for supplying the processing liquid that coheres the coloring materials in ink; processing liquid application means for applying the processing liquid to an area of the recording medium before images to be recorded on it; recording medium feeding means capable of setting the feeding pitch of the recording medium at plural steps, here the distance between the discharge port of the discharge port array on the uppermost stream side in the feeding direction of the recording medium, and the application point of the processing liquid application means to the recording medium being set at integral times at least one feeding pitch of the plural feeding pitches of the recording medium.

It is still another object of the invention to provide an image formation apparatus using an ink jet recording head for recording by discharging ink from the discharge ports onto a recording medium, including processing liquid supply means for supplying the processing liquid that coheres the coloring materials in ink; processing liquid application means for applying the processing liquid to an area of the recording medium before images to be recorded on it; and processing liquid carrier means for carrying the processing liquid to the application point of processing liquid application means on the recording medium, here the distance for the processing liquid to be carried being set at integral times the feeding pitch of the recording medium.

It is still another object of the invention to provide an image formation apparatus using an ink jet recording head for recording by discharging ink from the discharge ports onto a recording medium, including processing liquid supply means for supplying the processing liquid that coheres the coloring materials in ink; processing liquid application means for applying the processing liquid to an area of the recording medium before images to be recorded on it; processing liquid carrier means for carrying the processing liquid to the application point of the processing liquid application means on the recording medium; and recording medium feeding means capable of setting the feeding pitch of the recording medium at plural steps, here the distance for the processing liquid to be carried being set at integral times at least one feeding pitch of the plural feeding pitches of the recording medium.

It is another object of the invention to provide an image formation apparatus using an ink jet recording head for recording by discharging ink from the discharge ports onto a recording medium, including processing liquid supply means for supplying the processing liquid that coheres the coloring materials in ink; processing liquid application means for applying the processing liquid to an area of the recording medium before images to be recorded on it while being rotatively in contact with such area, here the rotational direction of the processing liquid application means being opposite to the feeding direction of the recording medium.

DETAILED DESCRIPTION OF THE PREFERRED EMBODIMENTS

Hereinafter, with reference to the accompanying drawings, the description will be made of each embodiment in accordance with the present invention.

The image formation apparatus that will be described below is an ink jet image formation apparatus using an ink jet type recording head to form desired images on a recording medium. This apparatus carries out recording by holding the ink jet recording head on a head holding unit such as a carriage for recording by discharging ink from the ink discharge ports onto a recording medium. Then, the recording by use of an ink jet recording head of the kind is characterized in that highly precise color images are obtainable with lesser noises at higher speeds at lower running costs. Also, for the ink jet recording head, electrothermal transducing elements or electromechanical transducing elements are used as energy generating elements to cause ink to be discharged. Particularly those using electrothermal transducing elements can be fabricated by the utilization of semiconductor manufacturing processes so as to implement making the head structure more compact.

First Embodiment

Figure 1:
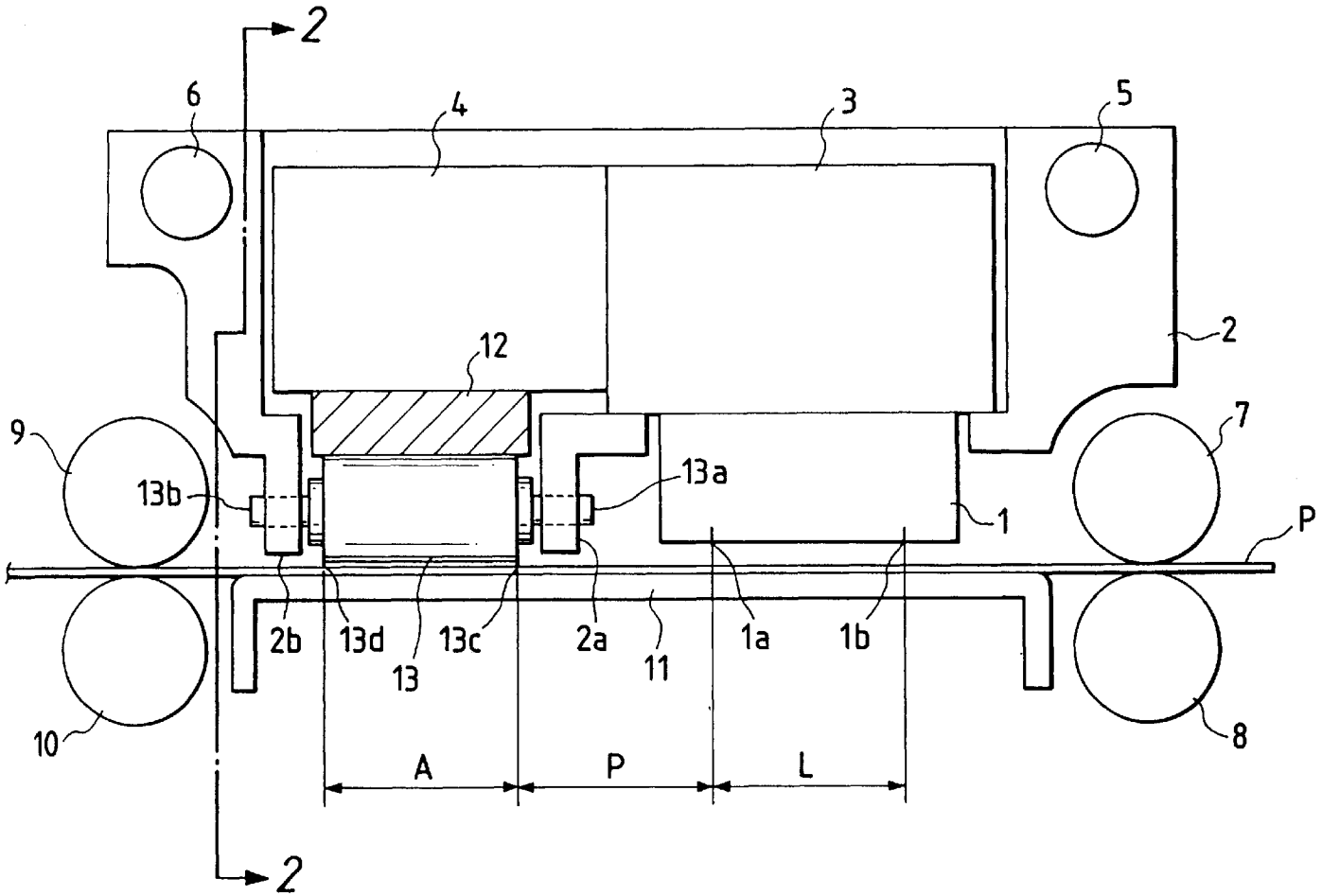
FIG. 1 is a cross-sectional view which shows the principal part of an image formation apparatus in accordance with a first embodiment of the present invention.

With reference to FIG. 1, the description will be made of a first embodiment in accordance with the present invention.

A recording head 1 is mounted on a carriage 2 together with a tank 3 retaining ink containing coloring materials, and a processing liquid storage 4. The carriage 2 is supported by rails 5 and 6 fixed to a housing (not shown) to be movable in the directions toward the front and back sides of FIG. 1. The tank 3 and processing liquid storage 4 are arranged to be exchangeable with respect to the carriage 2. A recording medium P is pinched by two feed roller pairs 7, 8 and 9, 10, respectively, so that it can be fed in the right-hand direction in FIG. 1. Below the tank 3 and processing liquid storage 4, and above the recording medium P and a platen 11, an application roller 13 is arranged. Its shafts 13*a* and 13*b* are rotatively supported by the bearings 2*a* and 2*b* of the carriage 2. Also, an absorbent 12 is arranged in a mode that it contacts both the application roller 13 and processing liquid storage 4.

Here, the positional relationship is arranged between each of the aforesaid components as follows:

$$L=A=P$$

where L is the distance between a nozzle 1*a* on the uppermost stream side in the feeding direction of the recording medium P (in the right-hand direction in FIG. 1) and a nozzle 1*b* on the lowermost stream side on the nozzle array (ink discharge port array) of the recording head 1;

A is the application width of processing liquid on the application roller 13; and P is the distance between the nozzle 1*a* of the recording head 1 on the uppermost stream side and the application point 13*c* on the lowermost stream side in the feeding direction of the recording medium P on the processing liquid application area of the application roller 13.

Now, the operation of an image formation will be described. The recording medium P is carried by means of a feeding mechanism (not shown) to the feed roller pair 9 and 10, and then, the recording medium P advances in the right-hand direction in FIG. 1 by the driving force of the feed roller pair 9 and 10. The recording medium P is further fed in the right-hand direction, and when the leading end thereof passes the application point 13*c* on the lowermost stream side, the feeding of the recording medium P is once suspended. Then, the carriage 2 that has been retracted from above the recording medium P to the depth direction of FIG. 1 is caused to scan toward the front side of FIG. 1. In this way, along the traveling of the carriage 2, the application roller 13 rotates while being in contact with the recording medium P, thus applying the processing liquid on the recording medium. At this juncture, the processing liquid is being supplied from the processing liquid storage 4 to the application roller 13 through the absorbent 12 appropriately. After that, the recording medium P is fed in the right-hand direction by a feeding amount L (=A=P), and then, the carriage 2 is caused to scan in the depth direction of FIG. 1. Thus, along the reversed traveling operation of the carriage 2, the application roller 13 rotates in the same manner as described above, while being in contact with the recording medium P to apply the processing liquid to the recording medium P. Then, after the recording medium P is fed in the right-hand direction by a feeding amount L (=A=P), the carriage 2 is caused to scan to the front side of FIG. 1 while allowing the recording head 1 to discharge ink at an appropriate timing. In this way, images are formed while the processing liquid and ink being caused to react on the recording medium P. At the same time, along the scanning operation of the carriage 2, the processing liquid is being applied to the recording medium P by means of the application roller 13 on the upstream side of the recording head in the same manner as described above. Thereafter, the feeding of the recording medium P and scanning operation of the carriage 2 are repeated to form images on the entire surface of the recording medium, while causing the processing liquid and ink to react upon each other thereon.

As referred to in the present embodiment, if the relationship of L=A is maintained, it is possible to regulate the density of processing liquid distribution on the recording area where ink is applied per main scanning operation of the ink jet recording head.

Also, if each of the components is arranged in the positional relationship of L=P, it is possible to regulate the temporal gap from the application of processing liquid to the recording operation by use of ink at any time of the main scanning of the carriage. Therefore, the permeation level of the processing liquid becomes even with respect to a recording medium.

In this respect, the aforesaid processing liquid (colorless liquid) that makes ink colors insoluble is obtainable as given below, for example.

In other words, after the following components are mixed and dissolved, the mixture is filtered under pressure by use of a membrane filter whose pour size is 0.22 $\mu$m (Product name: Fluoropour filter manufactured by Sumitomo Electric Industries Ltd.), and then, pH is adjusted to be 4.8 by NaOH to obtain a colorless liquid A1.

A1 Component

| | |
|---|---|
| Low molecular component of cationic compound<br>Stearyl trimethyl ammonium chloride<br>(Product name: Electrostopper QE by Kao Corp.) | 2.0 |
| High molecular component of cationic compound<br>Polyamine sulfone (Average molecular weight: 5,000)<br>(Product name: PAS-92 By Nitto Boseki Co., Ltd.) | 3.0 |
| Thiodiglycol | 10.0 |
| Water | remainder |

Also, the following can be cited as a suitable example of ink that becomes insoluble when mixed with the aforesaid colorless liquid.

In other words, ink Y1, M1, C1, and K1 of yellow, magenta, cyan, and black, respectively, are obtainable by mixing the following components with each of them and filtering each of such mixtures under pressure by use of the membrane filter whose pour size is 0.22 μm (Product name: Fluoropour filter by Sumitomo Electric Industries Ltd.): Y1

| | |
|---|---|
| C.I. direct yellow-142 | 2 |
| Thiodiglycol | 10 |
| Acetylenol EH (Kawaken Fine Chemical Co., Ltd.) | 0.05 |
| water | remainder |

M1

The same component as Y1 with the exception of the color;

| | |
|---|---|
| C.I. acid red-289 | 2.5 |

C1

The same component as Y1 with the exception of the color;

| | |
|---|---|
| C.I. acid blue-9 | 2.5 |

K1

The same component as Y1 with the exception of the color;

| | |
|---|---|
| C.I. food black-2 | 2.5 |

When mixing the respective colorless liquid with ink, the mixture takes place on a printing material or in the position where the mixture is permeated in accordance with the present invention. As a result, the low molecular weight component in the cationic substance contained in the colorless liquid and each of the water soluble colors having anionic group used for ink are associated by the ionic interaction as the first stage of reaction, thus causing the separation from the solution phase instantaneously.

Then, as the second stage of reaction, the associated element of each color and low molecular cationic substance is absorbed by the high molecular component contained in the colorless liquid. Therefore, the size of the cohesive color element resulting from such association becomes larger, thus making it difficult for this element to enter the gaps between fibers of a printing material. As a result, only the liquid portion separated from the solid is permeated into the recording paper. In this way, the provision of both good quality and fastness of prints is obtainable. At the same time, the cohesive element, which is formed by the low molecular component of the cation substance created by such mechanism as described above, as well as by the anionic color and the cationic substance, becomes more viscous. It does not move along the movement of fluid medium. Therefore, even if adjacent ink dots are formed by ink of different colors as in the case of a full-color image formation, these dots are not mixed with each other. Any bleeding does not take place, either. Also, the aforesaid cohesive element is fundamentally insoluble by water. As a result, the water resistance of an image thus formed becomes perfect. Also, there is an effect that the color fastness to light is enhanced for the image thus formed because of the polymeric shielding effect.

Also, in accordance with the present embodiment, there is no need for use of the cationic high molecular substance having a large molecular weight or polyvalent metallic salt as in the conventional art or even if these elements should be needed, its use could only be supplementary in anticipation of a further enhancement of the effect of the present invention. The amount of use thereof should be minimized. Therefore, the present invention demonstrates as a side effect that it solves the problem of lowered coloring capability of dyes resulting from any attempt to obtain a good water resistance using the cationic high molecular substance or polyvalent metallic salt as in the conventional art.

In this respect, there is no particular restriction on the printing materials to be used when embodying the present invention. It is possible to suitably use the so-called ordinary paper, such as copying paper, bond paper, which are conventionally used. It is of course possible to suitably use the coated paper or OHP transparent film specially produced for use of ink jet printing. The high quality paper and glossy paper generally used can also be usable suitably.

Here, when embodying the present invention, the ink to be used is not necessarily limited to any particular color ink. It is possible to use a pigment ink in which pigments are dispersed. Also, the processing liquid to be used can be the one that coheres such pigments. There can be cited as an example the following pigment ink that may produce cohesion when mixed with the aforesaid colorless liquid A1. In other words, ink Y2, M2, C2, and K2 of yellow, magenta, cyan, and black containing each coloring pigment and anionic compound are obtainable as described below.

Black Ink K2

Using as dispersant anionic high molecular P-1 (styrene-methacrylic acid-ethylacrylate, acid value 400, average molecular weight 6,000, water solution of 20% solid, neutralization agent:sodium hydroxide), the materials given below are put into a butch type vertical sand mill (manufactured by Imex) with glass beads of 1 mm diameter each as fillers, and dispersion process is given for three hours with water cooling. The viscosity after dispersion is 9 cps and pH is 10.0. This dispersed liquid is processed by use of a centrifugal separator to remove coarse grains for the production of carbon black dispersing elements whose weight average of granular diameter is 100 nm.

Component of Carbon Black Dispersing Element

| | |
|---|---|
| P-1 water solution (solid 20%) | 40 |
| Carbon black Mogul L (by Cablack) | 24 |
| Glycerol | 15 |
| Ethylene glycol monobutyl ether | 0.5 |
| Isopropyl alcohol | 3 |
| water | 135 |

Then, by sufficiently dispersing such element thus prepared, the black ink K2 containing pigment for ink jet use is obtained. The solid of the finally adjusted substance is approximately 10%.

Yellow Ink Y2

Using as dispersant anionic high molecular P-2 (Styrene-acrylic acid-methyl meta acrylate, acid value 280, average molecular weight 11,000, water solution of 20% solid, neutralization agent: diethanol-amine), dispersion process is executed as in the black ink K2 production using the materials given below to prepare yellow dispersing elements whose weight average granular diameter is 103 nm.

Component of Yellow Dispersing Element

| | |
|---|---|
| P-2 water solution (solid 20%) | 35 |
| C.I. pigment yellow 180 (novapalm yellow PH-G, by Hexist) | 24 |
| Triethylene glycol | 10 |
| Diethylene glycol | 10 |
| Ethylene glycol monobutyl ether | 1.0 |
| Isopropyl alcohol | 0.5 |
| Water | 135 |

Then, by sufficiently dispersing such element thus prepared, the yellow ink Y2 containing pigment for ink jet use is obtained. The solid of the finally adjusted substance is approximately 10%.

Cyan Ink C2

Using the anionic high molecular P-1 used for the production of the black ink K2 as dispersant, the same dispersion process is executed with the materials given below as in the case of the carbon black dispersing element, thus producing cyan color dispersing elements whose weight average granular diameter is 120 nm.

Component of Cyan Color Dispersing Element

| | |
|---|---|
| P-1 water solution (soil 20%) | 30 |
| C.I. pigment blue 15:3 (Fastgen blue FGF, by Dainippon Ink and Chemicals Inc.) | 24 |
| Glycerol | 15 |
| Diethylene glycol monobutyl ether | 0.5 |
| Isopropyl alcohol | 3 |
| Water | 135 |

Then, by sufficiently agitating such element thus prepared, the cyan ink C2 containing pigment for ink jet use is obtained. The solid of the finally adjusted substance is approximately 9.6%.

Magenta Ink M2

Using the anionic high molecular P-1 used for the production of the black ink K2 as dispersant, the dispersion process is executed with the materials given below as in the case of the carbon black dispersing element, thus producing magenta color dispersing elements whose weight average granular diameter is 115 nm.

Component of Magenta Color Dispersing Element

| | |
|---|---|
| P-1 water solution (solid 20%) | 20 |
| C.I. pigment red 122 (by Dainippon Ink and Chemicals Inc.) | 24 |
| Glycerol | 15 |
| Isopropyl Alcohol | 3 |
| Water | 135 |

Then, by sufficiently dispersing such element thus prepared, the magenta ink M2 containing pigment for ink jet use is obtained. The solid of the finally adjusted substance is approximately 9.2%.

Second Embodiment

Now, in conjunction with FIG. 2, the description will be made of a second embodiment in accordance with the present invention.

Figure 2:
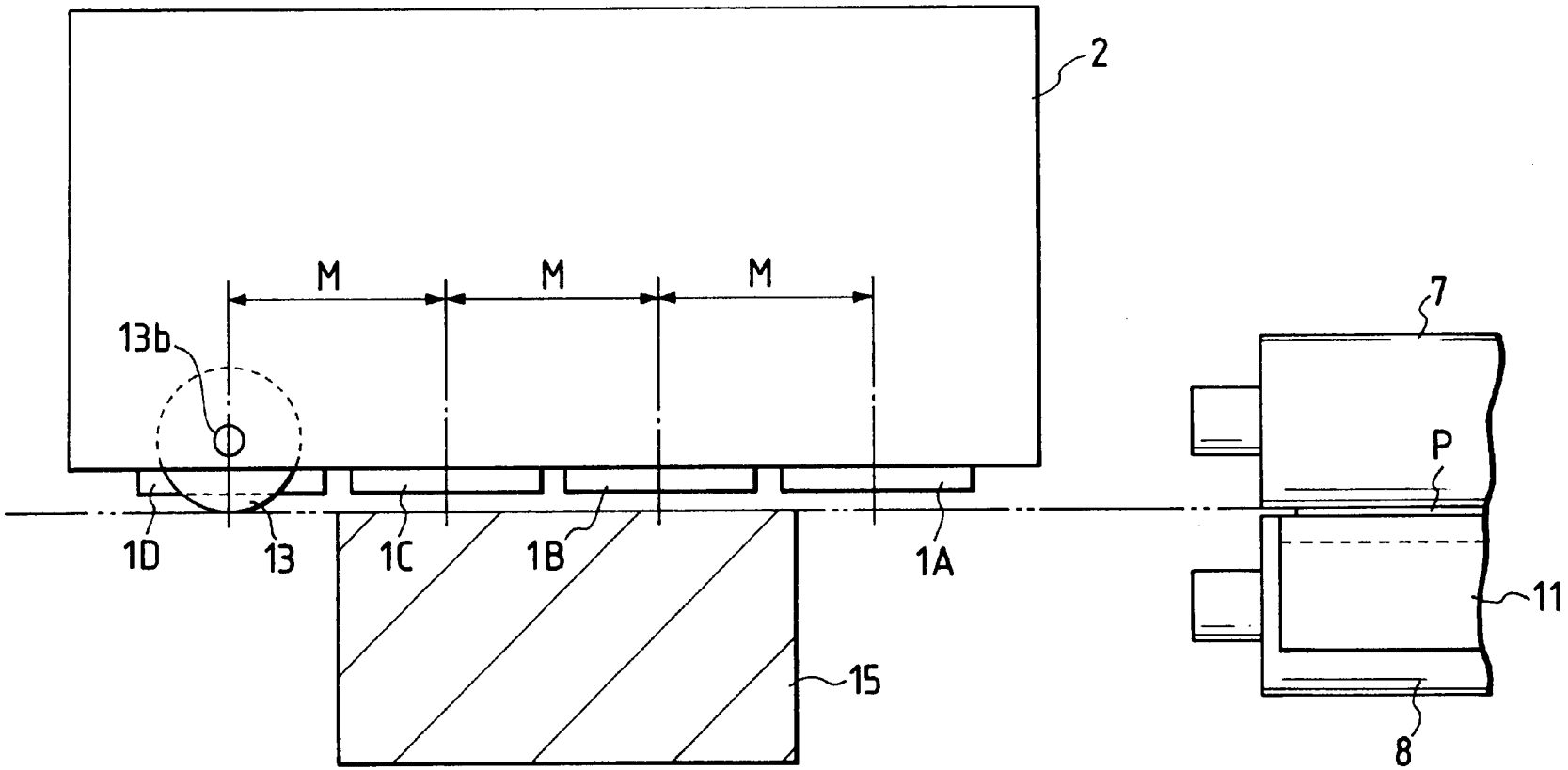
FIG. 2 is a cross-sectional view which shows the principal part of an image formation apparatus in accordance with a second embodiment of the present invention.

FIG. 2 is a cross-sectional view taken along line 2—2 in FIG. 1, but an embodiment that differs from the first embodiment is incorporated in it.

The same reference numerals are applied to the same members as those appearing in the first embodiment, and any repeated description will be omitted.

What differs from the first embodiment are: a plurality of recording heads mounted on a carriage; the arrangement position of the application roller; and means for supplying processing liquid to the application roller. Now, these will be described below.

FIG. 2 shows the state that the carriage 2 is on standby at the home position. Four recording heads 1A, 1B, 1C, and 1D are arranged and mounted on the carriage 2 each at an equal pitch M in the scanning direction (main scanning direction) thereof.

An application roller 13 is arranged on the upstream side (on the front side of FIG. 2) of the recording head group 1A to 1D in the sub-scanning direction, the direction in which a recording medium P is fed. In the main scanning direction, that is, the direction in which images are formed, this roller is arranged in the same position as the discharge center of the recording head 1D positioned furthermost from the recording medium P. At this juncture, the position of the main scanning direction of the application roller 13 is not necessarily identical to the discharge center of the recording head 1D strictly. It may be possible to shift the application roller 13 slightly in the right-hand direction in FIG. 2 in consideration of the positional intersection of each of members and others.

A storing absorbent 15 that absorbs a large quantity of processing liquid is fixed to the interior of the main body housing, and arranged in a position in the height direction so that its upper surface is in contact with the lower end of the application roller 13 under an appropriate pressure. Also, the length of the storing absorbent 15 in the left- and right-hand directions in FIG. 2 is almost equal to the length of one circle of the application roller 13.

With the structure described above, the recording medium P is once suspended at an appropriate position as in the first embodiment, and then, the carriage 2 is caused to scan in the right hand direction in FIG. 2. In this way, the application roller 13 rotates on the storing absorbent 15 to receive the supply of processing liquid. The application roller 13 rotates further while being in contact with the recording medium P. Thus the processing liquid is being applied to the recording medium P to obtain the same effects as the first embodiment. The other aspects of the method for forming images are the same as those of the first embodiment.

Third Embodiment

Now, in conjunction with FIG. 3 and FIG. 4, the description will be made of a third embodiment in accordance with the present invention.

For the present embodiment, too, the same reference numerals are applied to the same members as those appearing in the previous embodiment group, and any repeated description thereof will be omitted.

Figure 3:
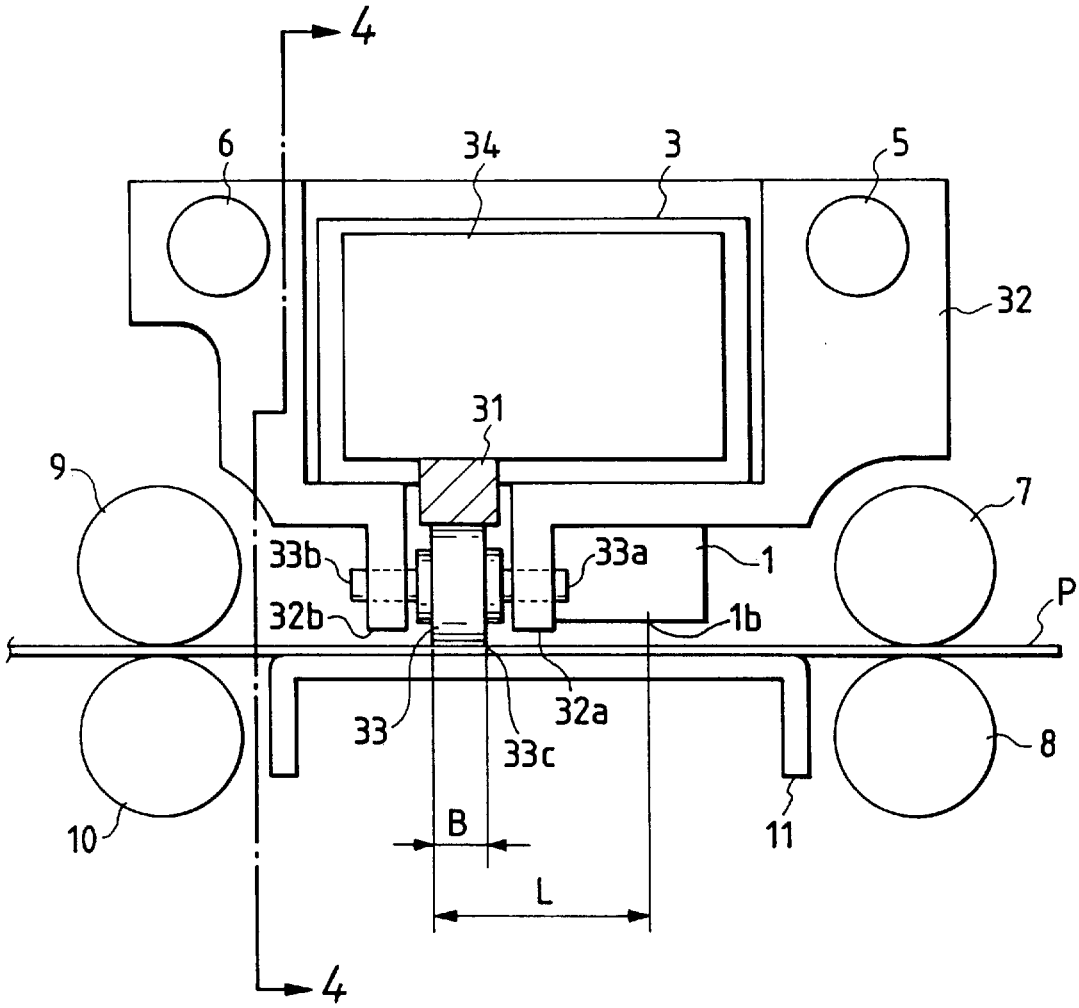
FIG. 3 is a cross-sectional view which shows the principal part of an image formation apparatus in accordance with a third embodiment of the present invention.

FIG. 3 is a cross-sectional view which shows the principal part of the present embodiment as in FIG. 1. FIG. 4 is a sectional view taken along line 4—4 in FIG. 3, illustrating the state that a carriage 32 is on standby at the home position.

What differs from the first and second embodiments are: the feeding amount of a recording medium; the aspect regarding the length of the application unit of an application roller; and the arrangement position of the application roller. Now, these will be described below.

Four recording head groups 1A, 1B, 1C, and 1D are arranged and mounted on the carriage 32 in the scanning direction each at an equal pitch. The shafts 33*a* and 33*b* of the application roller 33 are rotatively supported by the bearing units 32*a* and 32*b* of the carriage 32.

Here, the positional relationship between each of the members described above is as given below.

$$L=4\times B$$

where L is the length of the recording medium P in the feeding direction (right-hand direction in FIG. 3) of each nozzle array of recording heads 1A to 1D; and B is the application width of processing liquid of the application roller 33.

Also, the application roller 33 is arranged in a position on the upstream side of the recording head 1A positioned most closely to the recording medium P in the main scanning direction, the direction in which images are formed so that the application point on the uppermost stream side in the sub-scanning direction on the processing liquid application area of the application roller 33 and the nozzle on the uppermost stream side of the recording head 1A are made identical in the sub-scanning direction, the direction in which the recording medium P is fed.

With the structure described above, the recording medium P is once suspended by the same method as the first embodiment when the leading end thereof passes the application point 33*c* of the application roller 33 on the lowermost stream side.

Figure 4:
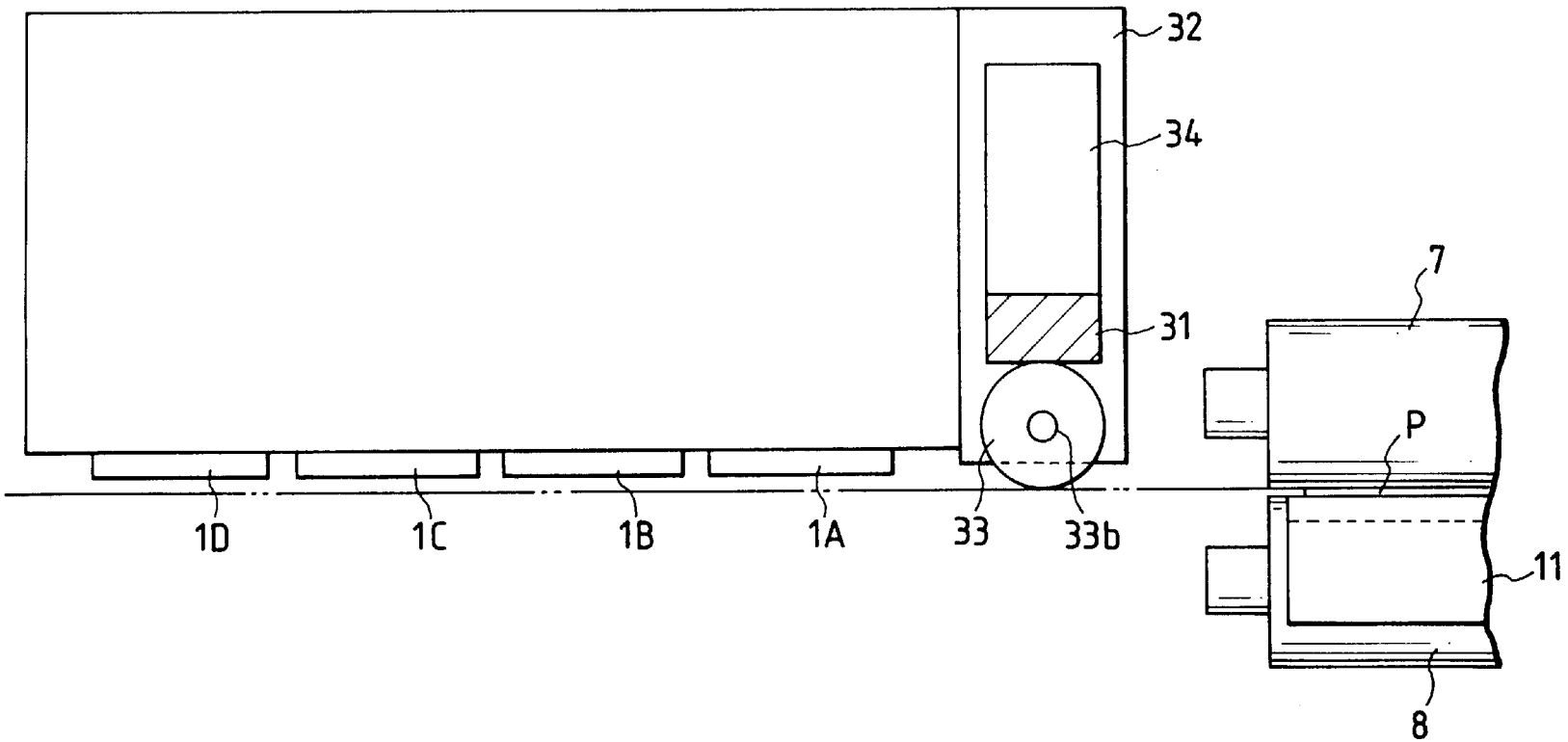
FIG. 4 is a cross-sectional view taken along line 4—4 in FIG. 3.

Then the carriage 32 that has been retracted to the position shown in FIG. 4 is caused to scan in the right-hand direction in FIG. 4. Thus, along the traveling of the carriage 32, the application roller 33 rotates while being in contact with the recording medium to apply the processing liquid on the recording medium P. At this juncture, the processing liquid is being supplied from the processing liquid storage 34 to the surface of the application roller 33 through the absorbent 31 appropriately. After that, the recording medium P shifts in the right-hand direction just by the feeding amount B (=L/4) as shown in FIG. 3, and then, the carriage 32 is caused to scan in the depth direction of FIG. 3. Thus along the reversed traveling of the carriage 32, the application roller 33 rotates while being in contact with the recording medium P as described earlier to apply the processing liquid on the recording medium P. In continuation, the recording medium P shifts in the right-hand direction just by the feeding amount B (=L/4) as shown in FIG. 3.

After this series of operation is repeated once, the carriage 32 is caused to scan in the right-hand direction in FIG. 4, while ink is being discharged from the recording head 1 at appropriate timing. In this way, while the processing liquid and ink react upon each other on the recording medium P, the original image data are thinned to ¼ for the formation of such image. At the same time, along the scanning operation of the carriage 32, the processing liquid is being applied by the application roller 33 to the recording medium P on the upstream side of the recording head 1 in the same manner as described earlier. Thereafter, the feeding of the recording medium P and the scanning operation of the carriage 32 are repeated to form images on the entire surface of the recording medium P, while causing the processing liquid and ink to react upon each other thereon.

In accordance with the present embodiment, the length L is set to an integer multiple of the application width B. In the above case, the integer multiple is 4, but it may be other integer multiples such as 2 as described below. When the integer multiple is 4, the feeding amount of the recording medium P is set at L/4 per feed, and the length B of the application unit of the application roller 33 is made identical to this amount of L/4 per feed. However, it may be possible to make the length of the application unit L/2, for example. Then it becomes possible to apply the processing liquid without wasting time even when the feeding of a recording medium P cab ne set for two kinds of feeding amounts, L/4 and L/2, and carry out the image formation without causing any uneven application of the processing liquid.

Also, it may be possible to arrange the application roller 33, processing liquid storage 34, and absorbent 31 of the present embodiment on the left-hand side of the recording head 1D positioned furthermost from the recording medium P in FIG. 4.

Moreover, the application roller 33 may be arranged by an appropriate method to be set apart from the recording medium P selectively.

Also, for the embodiments described above, the description has been made of the transfer system by use of an application roller as an example, but it may be possible to make such an arrangement as to use an absorbent containing processing liquid, which can be arranged to abut upon a recording medium directly, in place of the application roller.

Fourth Embodiment

Figure 5:
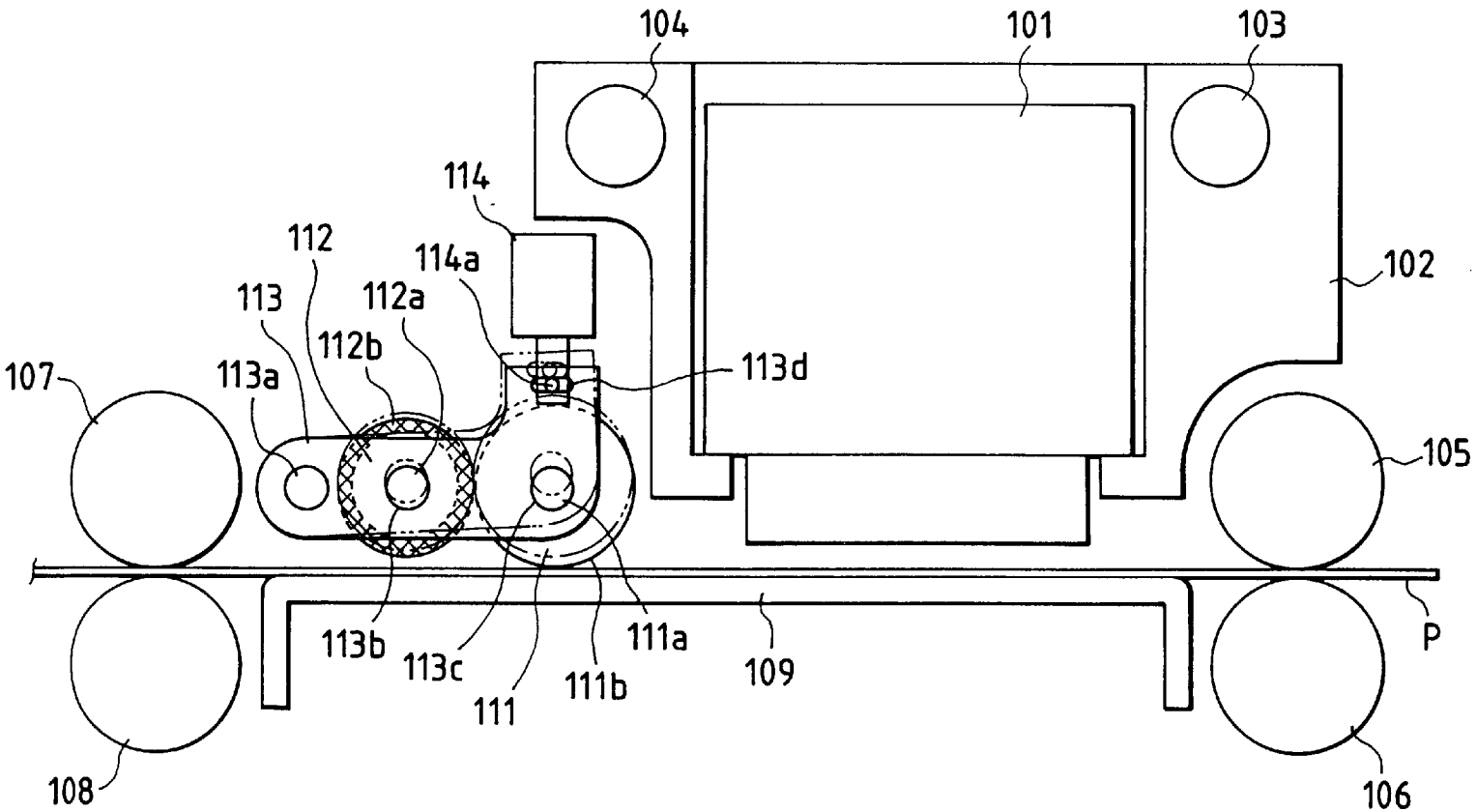
FIG. 5 is a cross-sectional view which shows the principal part of an image formation apparatus in accordance with a fourth embodiment of the present invention.

Now, in conjunction with FIG. 5, the description will be made of a fourth embodiment in accordance with the present invention, which makes it possible to set an application roller apart from a recording medium selectively.

A recording head 101 is fixed to a carriage 102. The carriage 102 is axially supported by rails 103 and 104 fixed to a housing (not shown) to be movable in the front and back side directions of FIG. 5. The recording medium P is pinched by two feed roller pairs 105, 106, and 107, 108 to be fed in the right-hand direction. The shafts 111*a* of a rubber transfer roller 111 is rotatively supported by the hole 113*c* of a swinging board 113. The shaft 112*a* of an impregnated roller 112 is fitted into the hole 113*b* of a swinging board 113 together with its impregnating unit 112*b* that retains processing liquid, thus rotatively supporting the impregnating unit 112*b* while keeping it in contact with the transfer roller 111. The shaft 113*a* of the swinging board 113 is rotatively supported, while engaging with the housing to hold the transfer roller 111 and impregnated roller 112. A solenoid 114 is fixed to the housing. The pin 114*a* of its shaft is fitted into an elongated hole 113*d* of the swinging board 113. Below the recording head 101, transfer roller 111, and impregnated roller 112, a platen 109 is arranged to support the recording medium P.

Now, the operation of image formation will be described. The recording medium P, which has been carried by a feeding mechanism (not shown) to the feed roller pair 107 and 108, advances in the right-hand direction in FIG. 5 by the driving force of the feed roller pair 107 and 108. At this juncture, the solenoid 114 is pulled upward in FIG. 5. As a result, the swinging board 113 rotates counterclockwise to reach a position indicated by two-dot chain line in FIG. 5. Therefore, the transfer roller 111 and impregnated roller 112 are also held in a state indicated by two-dot chain lines to maintain them to be in a detached state (detaching mode). As the feeding of the recording medium P advances to cause its leading end to be placed directly underneath the abutting portion 11*b* of the transfer roller 111 and recording medium P, a sensor (not shown) detects its arrival and the excitation of the solenoid 114 is released by the application of signal from a controller. Consequently, the swinging board 113 rotates clockwise to cause the transfer roller 111 to abut upon the recording medium P (contacting mode). As the recording medium P is being fed in this state, the transfer roller 111 rotates along its feeding to apply the processing liquid on the surface of the recording medium P. Further, when the recording medium P is fed so that it arrives at a position indicated in FIG. 5, such position is sensed by the sensor (not shown) to suspend the feeding operation once by the application of signal from the controller. Then, the carriage 102 on standby in a given position on the back side of FIG. 5 operates its scanning in the direction toward the surface of FIG. 5. At the same time, ink is discharged from the recording head 101 to form images in good condition, while causing the processing liquid and ink to react upon each other on the recording medium P. At this juncture, if the standby state of the carriage 102 is made longer due to the transfer of image data or the like so that the suspension time of the recording medium becomes longer than a regulated one, it may be possible to excite the solenoid 114 to release the transfer roller 111 until a sheet feeding next time. By repeating the operation described above, images are formed on the entire surface of a recording medium. Also, depending on the kinds of recording medium, it may be possible to excite the solenoid at all times, while images are being formed, to keep the transfer roller 111 to be detached from the recording medium P. For the present embodiment, the switching over of the detaching and contacting modes is conducted by whether the solenoid is excited or not. This event is controlled by the application of signals from a controller and a mechanical control unit (see FIG. 22).

Fifth Embodiment

Figure 6:
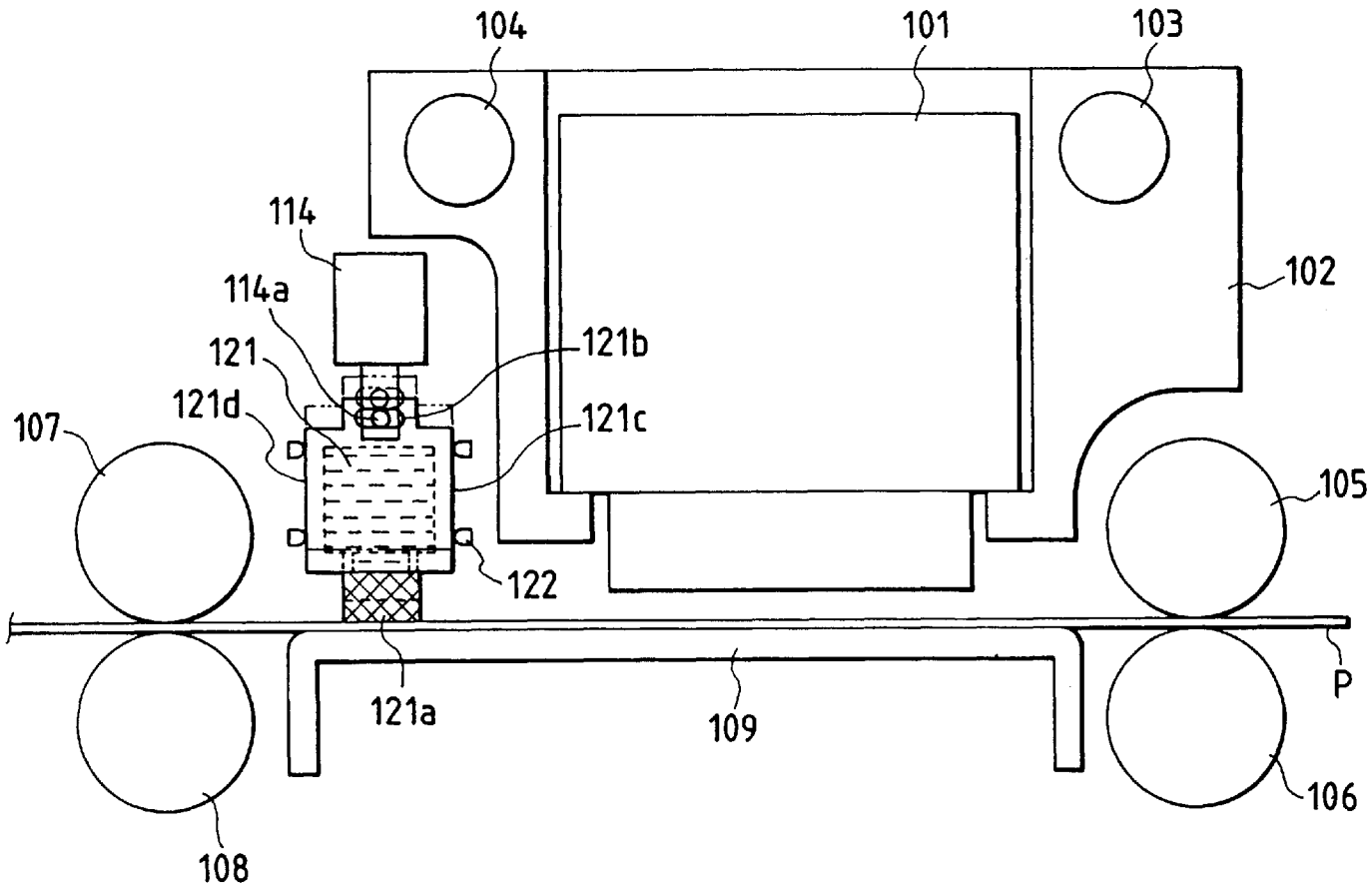
FIG. 6 is a cross-sectional view which shows the principal part of an image formation apparatus in accordance with a fifth embodiment of the present invention.

Now, in conjunction with FIG. 6, the description will be made of a fifth embodiment in accordance with the present invention.

The same reference numerals are applied to the same members as those appearing in the fourth embodiment, and the description thereof will be omitted.

What differs from the fourth embodiment is that means for applying processing liquid is not only constituted by the transfer roller 111, but also, by a processing liquid tank 121 having its application unit formed by a porous element 121*a*. In other words, the processing liquid tank 121 is supported by a supporting member 122 of the housing at its side faces 121*c* and 121*d* to be movable up and downward. In its interior, processing liquid is stored. On the lower portion thereof, the porous element 121*a* is arranged. On the upper portion thereof, an elongated hole 121 is provided to allow the pin 114*a* of the solenoid 114 to be fitted in. With the structure described above, images are formed as in the fourth embodiment. However, although the detaching and contacting of the transfer roller 111 is executed by use of the swinging board 113 and solenoid 114 in the fourth embodiment, the operation of processing liquid application is suspended when it is not needed by detaching the porous element 121*a* from the recording medium P by pulling up the entire body of processing liquid tank 121 by use of the solenoid 114 to be in the state indicated by two-dot chain line in FIG. 6 in accordance with the present embodiment.

Also, by releasing the excitation of the solenoid, the processing liquid tank 121 is pulled down to cause the porous element 121*a* to abut upon the recording medium P for the execution of the processing liquid application.

In this respect, the present embodiment is not necessarily limited to the structure formed by the transfer roller and impregnated roller, but the application unit may be formed just by an impregnated member directly.

Sixth Embodiment

Figure 7:
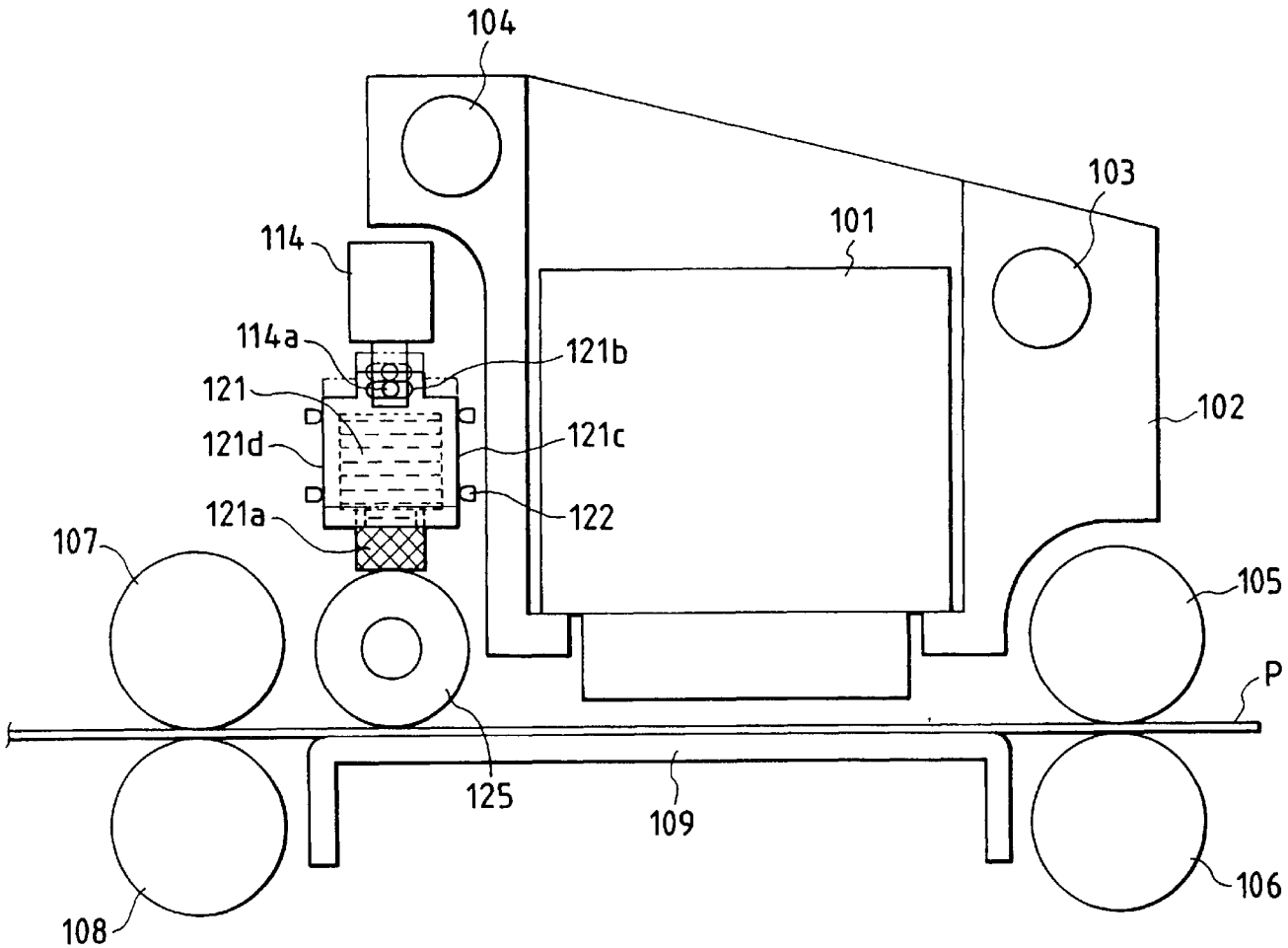
FIG. 7 is a cross-sectional view which shows the principal part of an image formation apparatus in accordance with a sixth embodiment of the present invention.

Now, in conjunction with FIG. 7, the description will be made of a seventh embodiment in accordance with the present invention.

In the present embodiment, too, the same reference numerals are applied to the same members as those appearing in the fourth, and fifth embodiments, and the description thereof will be omitted.

For the present embodiment, the application of processing liquid is performed by use of a transfer roller 125 as in the fourth embodiment, but the supply of the processing liquid to the transfer roller 125 is executed by means of a processing liquid tank 121 having a porous element 121*a*.

In other words, the transfer roller 125 is axially and rotatively supported on the housing, and above the roller, the processing liquid tank 121 is arranged. The side faces 121*c* and 121*d* of the tank is supported by a supporting unit 122 of the housing to be movable up and downward. In the interior of the tank, processing liquid is stored. On the lower part thereof, the porous element 121*a* is provided. Above it, an elongated hole 121*b* is arranged to allow the pin 114*a* of a solenoid 114 to be fitted in.

With the structure described above, images are formed as in the fourth embodiment. At this juncture, the transfer roller 125 cannot be detached from the recording medium P, but the processing liquid tank 121 can be set apart from the transfer roller 125. As a result, no supply of processing liquid is made to the transfer roller 125 because it is not executable in a state that the processing liquid tank 121 is set apart from the transfer roller. Hence there is no possibility that any processing liquid is applied wastefully or it is possible to avoid any excessive application of the processing liquid.

Seventh Embodiment

Figure 8:
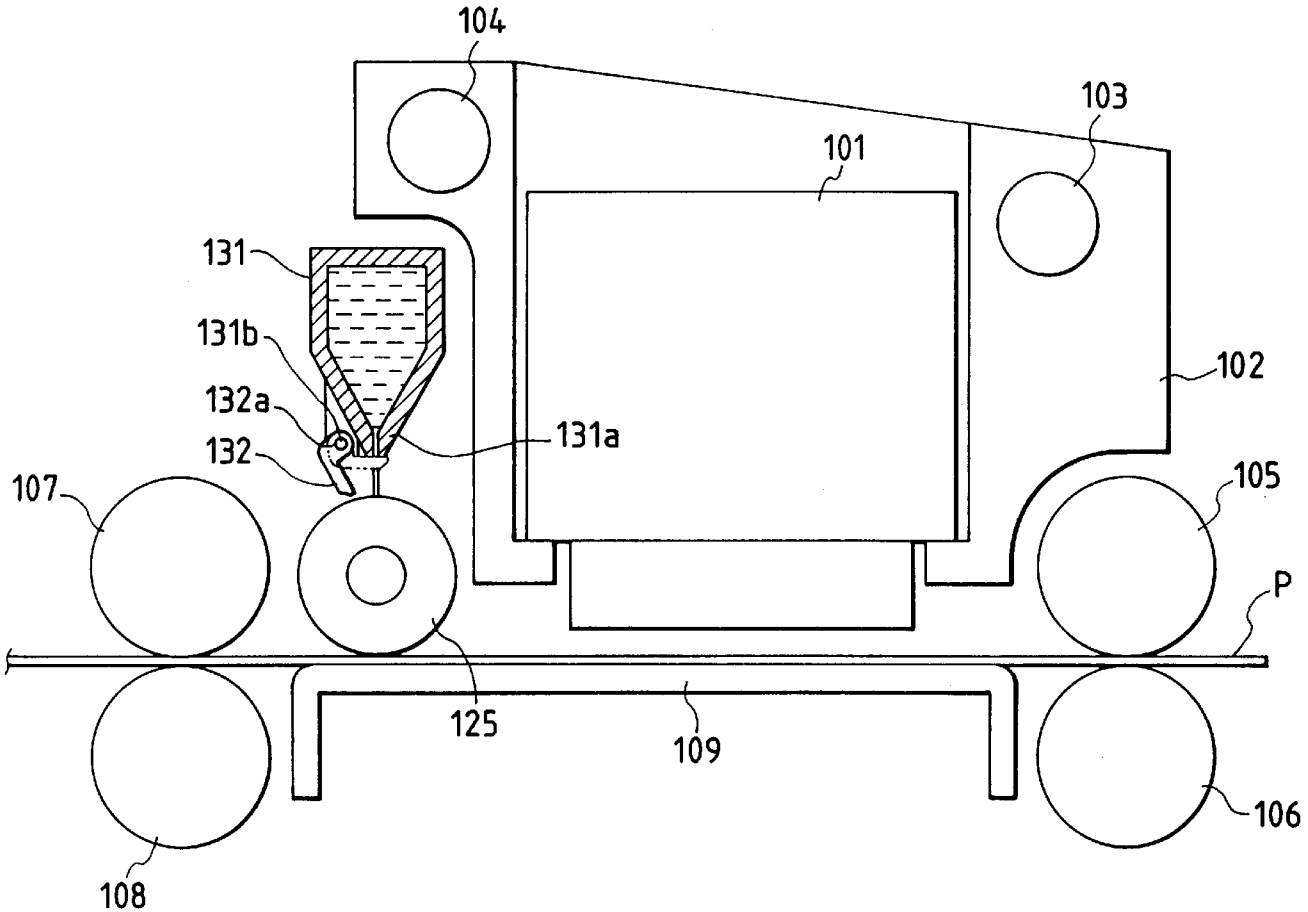
FIG. 8 is a cross-sectional view which shows the principal part of an image formation apparatus in accordance with a seventh embodiment of the present invention.

Now, in conjunction with FIG. 8, the description will be made of a seventh embodiment in accordance with the present invention.

In the present embodiment, too, the same reference numerals are applied to the same members as those appearing in the fourth, fifth, and sixth embodiments, and the description thereof will be omitted.

As in the sixth embodiment, a transfer roller 125 is used for the present embodiment, but the supply to the transfer roller 125 is executed by dropping the processing liquid from the processing liquid tank 131. The operation of such supply is suspended by use of a valve 132. The opening and closing of the valve 132, namely, the switching over of the operation and suspension of the supply mode, is conducted by operating the actuator (not shown) of the valve 132 by the application of signals from a controller and a mechanical controller (see FIG. 22) in accordance with image data and other recording conditions.

In other words, the transfer roller 125 is axially and rotatively supported on the housing. Above it, a processing liquid tank 131 is arranged. The processing liquid tank 131 is fixed to the housing, and in the interior thereof, processing liquid is stored. Below it, fine hole 131*a* is arranged to allow the processing liquid to drop appropriately. The valve 132 is movably supported by fitting the shaft 131*b* of the processing liquid tank 131 into the hole 132*a* of the valve.

With the structure described above, images are formed as in the fourth embodiment. At this juncture, it is impossible to detach the transfer roller 125 from the recording medium P, but this supply of processing liquid to the transfer roller 125 can be suspended. As a result, the processing liquid is not supplied to the transfer roller in a state that such supply is suspended with respect to the transfer roller 125. Therefore, no application of the processing liquid is made wastefully or any excessive application thereof is avoided.

In this way, the supply of processing liquid is possible to the transfer roller 125 without any direct contact. It may be possible to adopt an spray method or the like.

Eighth Embodiment

Figure 9:
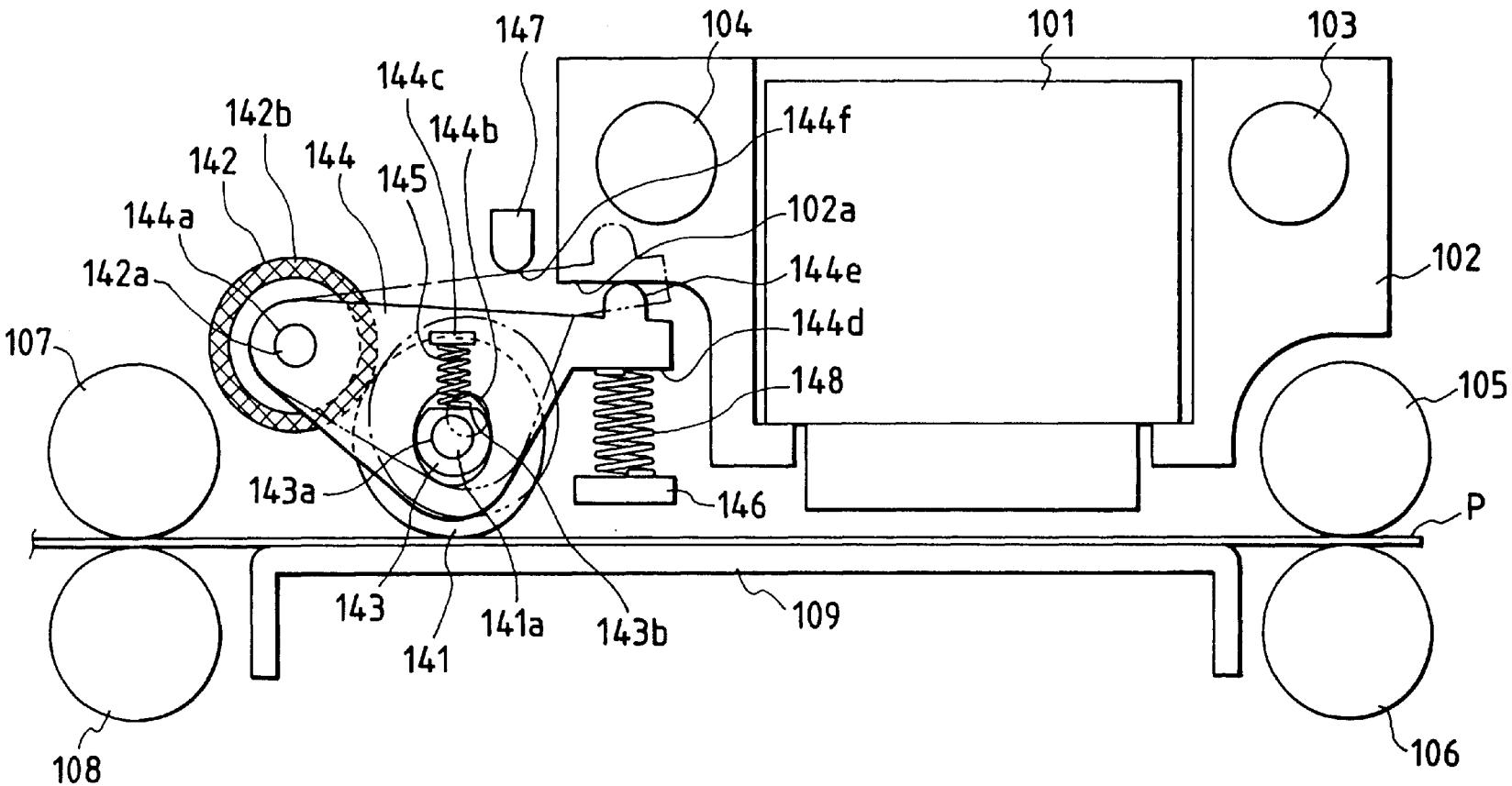
FIG. 9 is a cross-sectional view which shows the principal part of an image formation apparatus in accordance with an eighth embodiment of the present invention.

Now, in conjunction with FIG. 9, the description will be made of an eighth embodiment in accordance with the present invention.

In the present embodiment, too, the same reference numerals are applied to the same members as those appearing in the fourth to seventh embodiments, and the description thereof will be omitted.

In the present embodiment, the application and supply of processing liquid are the same as those method described in the fourth embodiment, but what differs are that only the transfer roller 141 is detached, and the detaching and contacting of the transfer roller 141 are performed by utilizing the operation of a carriage 102.

The rubber transfer roller 141 is supported by setting its shaft 141*a* into a bearing 143. The bearing 143 is supported in the elongated hole 144*b* of a swinging board 144 to be movable up and downward. Its flat portion 143*b* is pressed by a pressure spring 145. The pressure force is transmitted to the transfer roller 141. The shaft 142*a* of an impregnated roller 142 is fitted into the hole 144*a* of the swinging board 144 to support it rotatively. The pressure spring 145 is received by the spring receptacle 144*c* to bias the board counterclockwise by means of the returning spring 148 arranged between the fixing portion 146 of the housing and the flat portion 144*d* of the swinging board 146. The impregnated roller 142 retains processing liquid in its impregnating unit 142*b* and abuts upon the transfer roller 141. Also, an extrusion 147 is arranged as a stopper to check the upward movement of the swinging board 144.

Now, the operation of image formation will be described. By means of a feeding mechanism (not shown), the recording medium P is fed to the feed roller pair 107 and 108, and then, by the driving force of the feed roller pair 107 and 108, it is further fed in the right-hand direction in FIG. 9. At this juncture, the carriage 102 is in a position to detach the transfer roller 141 (the position where an element at 102*a* presses down an element at 144*e*) in the vertical direction in FIG. 9. Therefore, the swinging board 144 rotates counterclockwise to cause its upper face to be in contact with an abutting portion 147, thus being in the position indicated by two-dot chain line in FIG. 9. Consequently, the transfer roller 141 is also in detached condition held in a state as indicated by two dot chain line in FIG. 9. As the feeding of the recording medium P advances to place its leading end directly underneath the abutting portion between the transfer roller 141 and recording medium P, the carriage 102 shifts in the vertical direction in FIG. 9 from the position where it detaches the transfer roller 141 to the position where it causes the transfer roller 141 to be in contact in the vertical direction in FIG. 9.

Then, the bottom end 102*a* of the leading end of the carriage 102 pushes down the extrusion 144*e* of the swinging board 144. As a result, the swinging board 144 rotates clockwise to be in a position indicated by solid line in FIG. 9. Thus the transfer roller 141 abuts upon the recording medium P. In this state, when the recording medium P is further fed, the transfer roller 141 rotates along the feeding of the recording medium to apply the processing liquid on the surface of the recording medium P. Further, when the recording medium P is fed to the position shown in FIG. 9, the feeding operation is suspended once. Then the carriage 102 on standby in a given position in the vertical direction in FIG. 9 begins scanning in the vertical direction in FIG. 9, and at the same time, discharging ink from the recording head 101 to form images in good condition, while causing the processing liquid and ink to react upon each other on the surface of the recording medium P. At this juncture, the carriage 102 shifts to a position where it detaches the transfer roller 141 to maintain it in the detached state. Then the carriage 102 shifts from the position where it detaches the transfer roller 141 to the position where it causes the transfer roller to be in contact in the vertical direction in FIG. 9. In continuation, the feed roller pairs 105, 106, and 107, 108 rotate to feed the recording medium. At this juncture, as described above, the transfer roller 141 rotates along the feeding of the recording medium P to apply the processing liquid to the surface thereof. Also, after the termination of feeding operation, if the standby state of the carriage 102 is made longer due to the transfer of image data or the like to make the suspension time of the recording medium P longer than regulated, the carriage 102 is allowed to shift to the position where it detaches the transfer roller 141 in the vertical direction in FIG. 9. Then, until the recording operation of the recording head 101 is made ready, the transfer roller 141 may be released. The operations described above are repeated to form images on the entire surface of the recording medium.

The processing liquid that makes ink colors insoluble is obtainable as described earlier as an example. Then, switching over of detaching and contacting modes is performed by an event whether or not the recording head is in a specific position on the carriage. The motion of the carriage 102 is controlled by signals from a controller and a mechanical controller (see FIG. 22).

Ninth Embodiment

Now, hereunder, in accordance with ninth to thirteenth embodiments, the description will be made of structures with which to avoid executing any ink jet recording on the jointed portion of processing liquid applied by use of the application roller.

Figure 10:
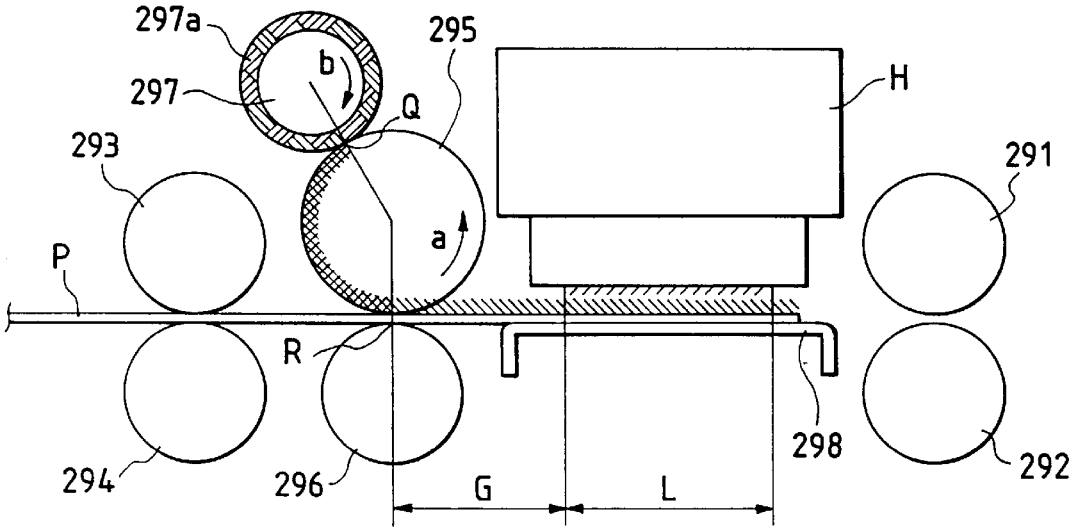
FIG. 10 is a vertically sectional view which schematically shows a state at the time of image formation by the first scanning when processing liquid is applied by use of an image formation apparatus.
Figure 11:
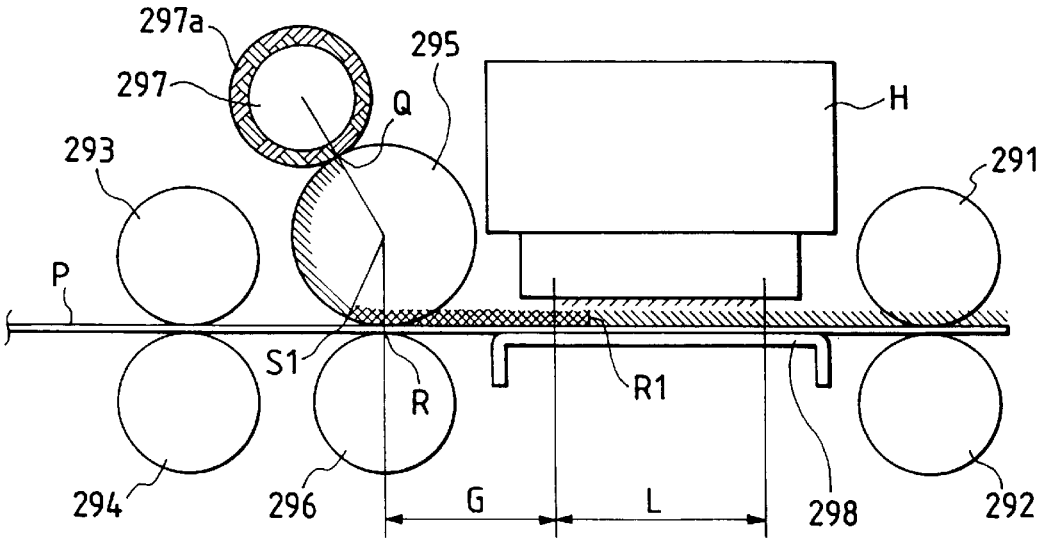
FIG. 11 is a vertically sectional view which schematically shows a state at the time of image formation by the second scanning of the image formation apparatus represented in FIG. 10.
Figure 12:
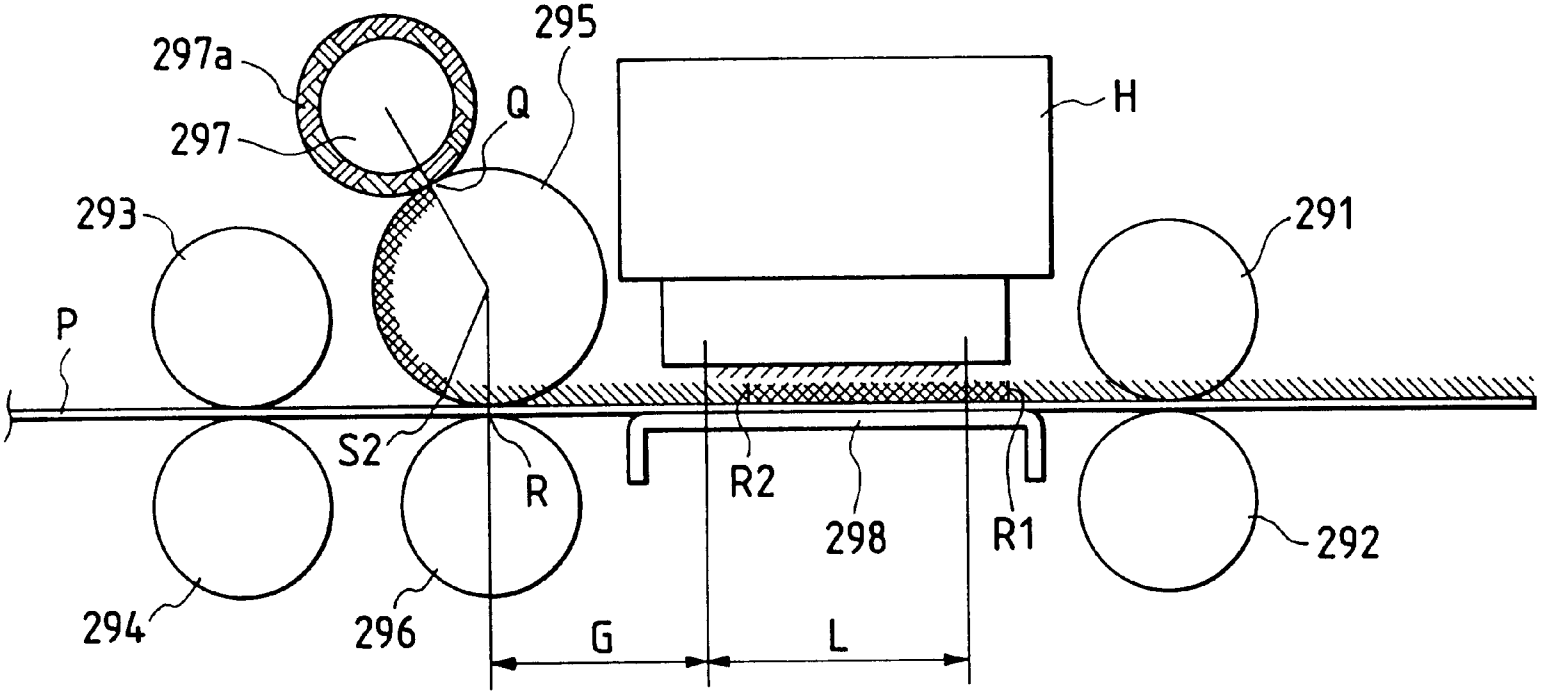
FIG. 12 is a vertically sectional view which schematically shows a state at the time of image formation by the third scanning of the image formation apparatus represented in FIG. 10.

FIG. 10 is a vertically sectional view which schematically shows a state that images are formed by the first scan in a case where processing liquid is applied by use of an image formation apparatus. FIG. 11 is a vertically sectional view which schematically shows a state that images are formed by the second scan by use of the image formation apparatus represented in FIG. 10. FIG. 12 is a vertically sectional view which schematically shows a state that images are formed by the third scan by use of the image formation apparatus represented in FIG. 10. Now, with reference to FIG. 10 to FIG. 12, the description will be made of a method for applying processing liquid by use of a roller.

In FIG. 10 to FIG. 12, paper P, which is a recording medium, is pinched and fed by two feed roller pairs 291, 292, and 293, 294. Between the two feed roller pairs 291, 292, and 293, 294, an ink jet recording head H is supported by a mechanism (not shown) in a position indicated in FIG. 10 to FIG. 12 so that it can reciprocate in the direction perpendicular to the surface of the figures. Below the recording head H, a platen 298 is arranged to hold the paper P (recording medium). On the upstream side of the recording head H in the feeding direction of the recording medium, a transfer roller 295 and a pressure roller 296, which constitute a roller pair, are axially supported. An impregnated roller 297 that impregnates the processing liquid is axially and rotatively supported by such a structure as to allow it to be in contact with the transfer roller 295.

Now, the operation of an image formation apparatus shown in FIGS. 10 to 12 will be described. At first, the recording medium (paper) P, which is carried from the right-hand side in FIG. 10, advances further in that direction when being pinched by the roller pair 293 and 294 on the upstream side. As shown in FIG. 10, the leading end of the paper P passes the transferring point R of the transfer roller 295. Then the transfer roller 209 rotates in the direction indicated by an arrow a. Therefore, an appropriate amount of the processing liquid is being applied to the upper surface of the paper P in the portion that follows as indicated by the hatching made by slanted lines falling to the right side.

At this juncture, the impregnated roller 297 rotates freely in the direction indicated by an arrow b. Therefore, the processing liquid in the impregnating unit 297*a* is being transferred and supplied orderly from the transferring point Q to the circumference of the transfer roller 295 as indicated by cross-hatching. Further, the paper P advances on the platen 298 in the right-hand direction, and it stops in the recordable area as shown in FIG. 10. In continuation, the recording head H scans in the direction perpendicular to the surface of FIG. 10 to discharge ink for the formation of images. In other words, the image formation by the first scan is performed. At this juncture, the cohesion of coloring materials in ink takes place by means of the process described earlier.

When the recording head H returns in the traveling direction perpendicular to the surface of FIG. 10, the two pair of feed rollers 291, 292, and 293, 294 again begin to rotate, thus causing the paper P to further advance in the right-hand direction. Then, it stops in a state shown in FIG. 11 where it has been carried from the state shown in FIG. 10 by the length L (height or width of one line) of the discharge port array. During this period of feeding, the transfer roller 295 and impregnated roller 297 rotate as described earlier, thus the processing liquid is orderly transferred and supplied to the transfer roller 295 and the paper P. In FIG. 11, the processing liquid newly applied to the paper P is indicated by cross-hatching. The processing liquid newly transferred to the transfer roller 295 is indicated by the hatching made by slanted lines falling to the right side.

Here, as in the first-scanned image formation, the recording head H discharges ink while scanning in the direction perpendicular to the surface of FIG. 11 for the formation of images. In other words, the image formation is performed by the second scan. At this juncture, the cohesion of coloring materials in ink takes place by means of the process described earlier. When the recording head returns in the traveling direction perpendicular to the surface of FIG. 11, the two pairs of feed rollers 291, 292, and 293, 294 again begin to rotate. Thus the paper P further advances in the right-hand direction.

Then, it stops in a state shown in FIG. 12 where it has been carried from the state shown in FIG. 11 by the length L (height or width of one line) of the discharge port array. During this period of feeding, the transfer roller 295 and impregnated roller 297 rotate as described earlier, thus the processing liquid is orderly transferred and supplied to the transfer roller 295 and the paper P. In FIG. 12, the processing liquid newly applied to the paper P is indicated by cross-hatching. The processing liquid newly transferred to the transfer roller 295 is indicated by the hatching made by slanted lines falling to the right side.

Here, it is possible to achieve the objectives of the present embodiments by arranging the structure in such a manner that the distance between the discharge ports and the application point of means for applying processing liquid to the recording medium is made integral times the minimum pitch of the plural amounts of feeding pitches.

Figure 13:
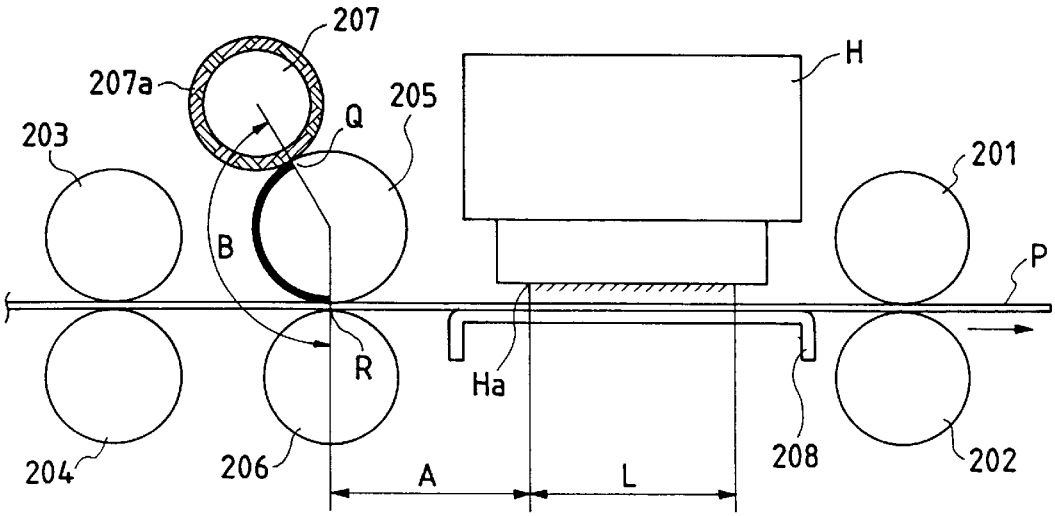
FIG. 13 is a vertically sectional view which schematically shows an image formation apparatus in accordance with a ninth embodiment of the present invention.

Hereinafter, with reference to FIG. 13 to FIG. 17, the description will be made of the embodiments in accordance with the present invention. Throughout these figures, the same reference numerals designate the same or corresponding members. FIG. 13 is a vertically sectional view which schematically shows an image formation apparatus in accordance with a ninth embodiment of the present invention. In FIG. 13, the paper P, which is a recording medium, is pinched and fed by two pairs of rollers 201, 202, and 203, 204. Between the two roller pairs 201, 202, and 203, 204, an ink jet recording head H is supported by a mechanism (not shown: a carriage mechanism, for example) so that it can reciprocate in the direction perpendicular to the surface of FIG. 13.

Below the recording head H, a platen 201 is arranged to guide and hold the paper P. On the upstream side of the recording head H in the feeding direction of the recording medium, a transfer roller 205 and a pressure roller 206 are axially supported to form a roller pair that abut upon each other. An impregnated roller 207 having an impregnating unit 207*a* is axially and rotatively supported with such a structure so as to allow it to be in contact with the transfer roller 205.

The ink jet recording head H is ink jet recording means for discharging ink by utilizing thermal energy, and it is provided with electrothermal transducing elements for generating thermal energy. Also, the recording head H utilizes the pressure changes brought about by the development and contraction of air bubbles created by the film boiling by thermal energy applied by the electrothermal transducing elements and discharges ink from the discharge ports for recording.

Now, the description will be made of the positional relationship between each of constituents shown in FIG. 13. The feeding direction of the recording medium P is from left to right as indicated by an arrow facing to the right in FIG. 13. Here, given L as the feeding amount of recording medium per feed (feeding pitch); A, as the distance from the discharge port Ha positioned uppermost stream of the discharge port array in the feeding direction of recording medium to the application point R of the transfer roller 205 to apply processing liquid to the recording medium; and B as the distance on the transfer roller 205 between the application point R of the transfer roller 205 and the transferring point Q of the impregnated roller 207 to transfer the processing liquid to the transfer roller 205 (indicated by a bold line in FIG. 13), these presents an relationship of A=B=L.

Therefore, the portion placed at the application point R shifts to the position directly beneath the discharge port Ha on the uppermost stream side even if the recording medium P is fed for the length L after images are formed on the recording medium P by use of the recording head H in the same procedures as in the case of the image formation apparatus described in conjunction with FIG. 10 to FIG. 12. As a result, when the next image formation is operated, the jointed portion of processing liquid is not brought into the recording area thereof.

Further, the processing liquid on the jointed portion between the transfer roller 205 and impregnated roller 207, that is, the portion at the transferring point Q where the processing liquid is transferred from the impregnated roller 207 to the transfer roller 205, is just placed above the application point R of the processing liquid from the transfer roller 205 to the recording medium P as a result of the feeding operation of the recording medium. Consequently, there is no temporal difference after the processing liquid is applied, hence making it possible to uniform the surface density of the processing liquid.

Also, if A and B cannot be made equal to L due to some arrangement requirements of an apparatus, it may be possible to set the relationship as A=m×L, B=n×L (m, n: integers). In this case, too, no jointed portion of the processing liquid is allowed to be in the recording area and on the transfer roller when the next image formation is operated.

Also, for an ink jet recording head having a plurality of discharge port arrays on it, a multipass recording is performed in order to obtain images of still better quality. This type of recording is such that images on one area are not recorded just by one-time recording operation, but the recording amount therefor is intermitted in order to reduce the density unevenness or the like in the final image, which may result from the variation of ink discharge amount or discharging orientation characteristic of each of the discharge ports. The final image is obtained by operating recording several times using different discharge port groups.

Meanwhile, the feeding of the recording medium is performed in such a manner that it is not fed for distance equivalent to the length of the discharge port array at a time, but the feeding is conducted by several divisions, and then, in accordance with the required image level, the image formation is performed by the application of two-time recording pass or by three-time recording pass as the case may be. In general, the more the recording passes, the more enhanced is the quality of a final image. Therefore, in some cases, means for feeding recording medium is arranged to be able to set the amount of feeding pitch of a recording medium at several steps.

Therefore, if the present invention is applied to an image formation apparatus capable of setting a plurality of feeding amounts of recording medium as described above, it should be good enough to from the positional relationship as follows: For example, given the plural amounts of feeding pitches as K1, K2, and K3, and if three kinds of feeding pitches can be set at K1=L, K2=L/2, and K3=L/3, it should be good enough to define the distance A and B in FIG. 13 as A=B=L in consideration of least common multiple of K1, K2, and K3.

In this case, it may be possible to set them at A=m×L, B=n×L (m, n: integers) as in the previous case. On the other hand, if the priority should be given only to the three-pass recording of a high image quality mode because of restrictions or the like in space wise, it may be possible to set them at A=B=L/3 or A=m×L/3, B=n×L/3 (m, n: integers).

Tenth Embodiment

Figure 14:
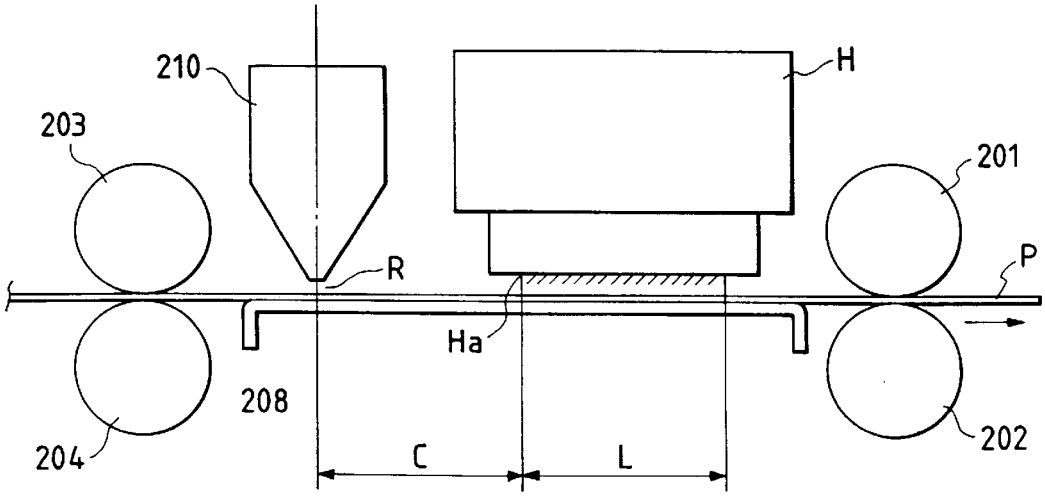
FIG. 14 is a vertically sectional view which schematically shows an image formation apparatus in accordance with a tenth embodiment of the present invention.

FIG. 14 is a vertically sectional view which schematically shows an image formation apparatus in accordance with a tenth embodiment of the present invention. In FIG. 14, a paper P, which is a recording medium, is pinched and fed by two roller pairs 201, 202, and 203, 204. Between the two roller pairs 201, 202, and 203, 204, an ink jet recording head H is supported by a mechanism (not shown: a carriage mechanism or the like) so that it can reciprocate in the direction perpendicular to the surface of FIG. 14. Below the recording head H, a platen 208 is arranged to guide and support the paper P. On the upper stream side of the recording head H in the feeding direction of the recording medium, a spray type processing liquid application mechanism 210 is arranged.

Now, the description will be made of the positional relationship between each of the constituents shown in FIG. 14. The feeding direction of the recording medium P is from left to right as indicated by an arrow facing to the right in FIG. 14. Here, given L as the feeding amount of the recording medium per feed (feeding pitch), and C as the distance from the discharge port Ha of the discharge port array on the uppermost stream side in the feeding direction of the recording medium to the application point R of the processing liquid to the recording medium P, which is positioned in the center of the spray type processing liquid application mechanism 10, these present a relationship of C=L.

Therefore, even if the recording medium P is fed for a length L after images are recorded on the recording medium P by use of the recording head H in the same procedure as in the case of the image formation apparatus described in conjunction with FIG. 10 to FIG. 12, the jointed portion of the processing liquid is not placed in the recording area when the next image formation is operated because the portion on the recording medium P directly underneath the application point R is placed directly underneath the discharge port Ha on the uppermost stream side.

Also, if the distance C cannot be made equal to the distance L in FIG. 14, due to the arrangement requirements of the apparatus, it may be possible to set them at a relationship of C=m×L (m: integer). In this case, too, the jointed portion of processing liquid is not allowed to be placed in the recording area when the next image formation is operated. Also, if an apparatus is provided with means for feeding recording medium, which is capable of setting the amounts of feeding pitches of the recording medium at plural steps, the positional relationship is set as given below. For example, given the amounts of feeding pitches as K1, K2, and K3, and if the three kinds of pitch amounts for feeding can be set at K1=L, K2=L/2, and K3=L/3, it should be good enough to define the distance L in FIG. 14 as C=L in consideration of least common multiple of K1, K2, and K3. In this case, it may be possible to define it as C=m×L (m: integer) as in the previous case. Meanwhile, if the priority should be given only to the three-pass recording of the high quality image mode due to restrictions or the like in spacewise, it may also be possible to define it as C=L/3 or C=m×L/3 (m: integer).

Eleventh Embodiment

Figure 15:
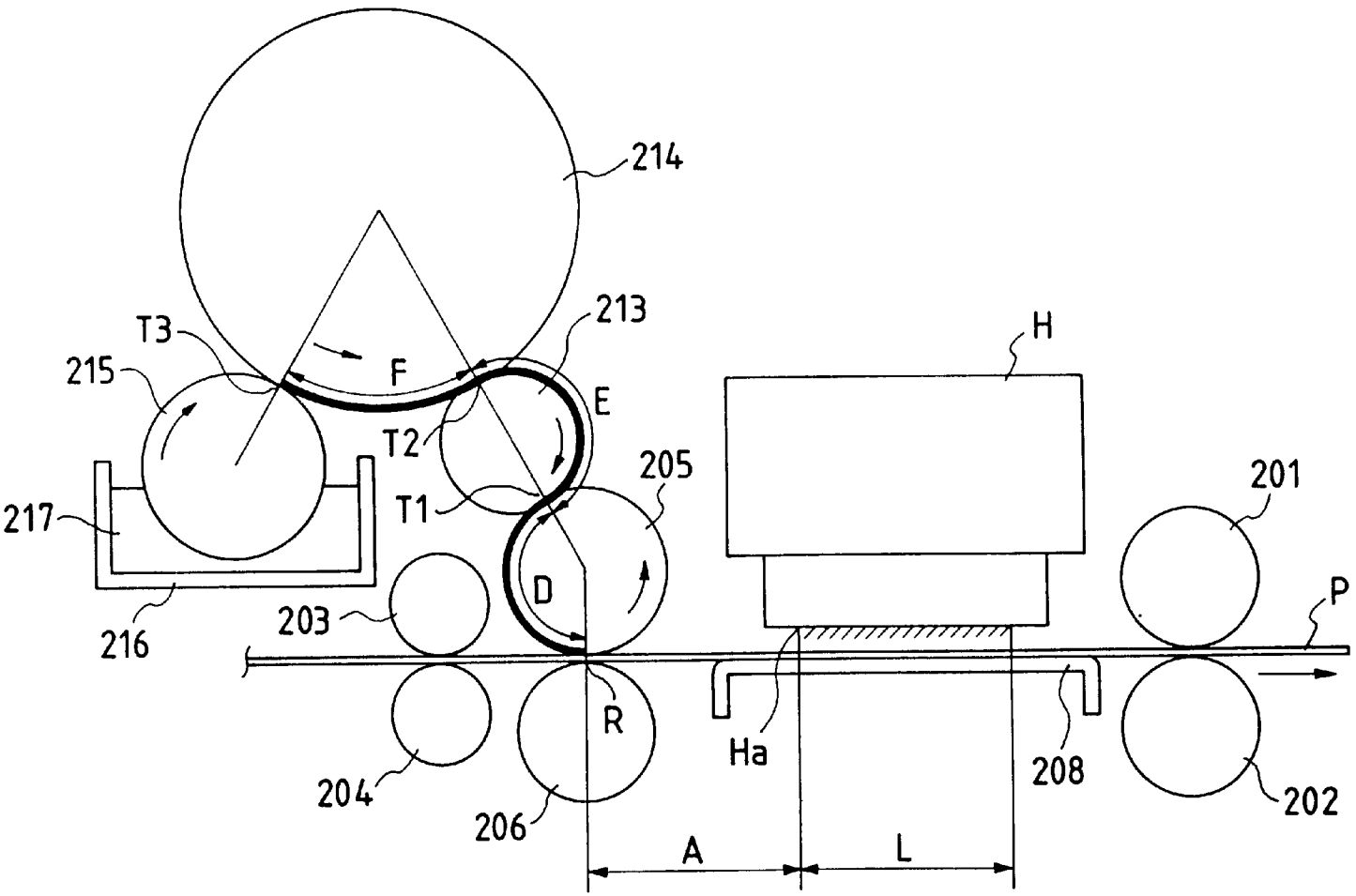
FIG. 15 is a vertically sectional view which schematically shows an image formation apparatus in accordance with an eleventh embodiment of the present invention.

FIG. 15 is a vertically sectional view which schematically shows an image formation apparatus in accordance with a eleventh embodiment of the present invention. In FIG. 15, a paper P, which is a recording medium, is pinched and fed by two roller pairs 201, 202, and 203, 204. Between the two roller pairs 201, 202, and 203, 204, an ink jet recording head H is supported by a mechanism (not shown: a carriage unit or the like) so that it can reciprocate in the direction perpendicular to the surface of FIG. 15.

Below the recording head H, a platen 208 is arranged to guide and support the paper P. On the upper stream side of the recording head H in the feeding direction of the recording medium, a transfer roller 205 and a pressure roller 206, which constitute a roller pair, are axially supported (to abut upon each other under pressure). An intermediate roller 213 is axially and rotatively supported in such a structure as to allow it to be in contact with the transfer roller 205.

Also, a relay roller 214 is axially and rotatively supported in such a structure as to allow it to be in contact with the intermediate roller 213. Further, a drawing roller 215 is axially and rotatively supported in such a structure as to allow it to be in contact with the relay roller 214. The drawing roller 215 is immersed in the processing liquid 217 stored in a tank 216. Now, the description will be made of the positional relationship between each of the constituents shown in FIG. 15. The feeding direction of the recording medium is from left to right as indicated by an arrow shown in FIG. 15.

Here, given L as the feeding amount of recording medium per feed (feeding pitch); A, the distance from the discharge port Ha in the uppermost stream side of the discharge port array in the feeding direction of the recording medium to the application point R of the transfer roller 205 to apply the processing liquid to the recording medium P; D, the distance on the transfer roller 205 (indicated by bold line in FIG. 15) from the application point R on the transfer roller 205 to the transferring point T1 of the intermediate roller 213 to transfer the processing liquid to the transfer roller 205; E, the distance on the intermediate roller 213 (indicated by bold line in FIG. 15) from the transferring point T1 of the intermediate roller 213 to transfer the processing liquid to the transfer roller 205 to the transferring point T2 of the relay roller 214 to transfer the processing liquid to the intermediate roller 213; and F, the distance on the relay roller 214 (indicated by bold line in FIG. 15) from the transferring point T2 of the relay roller 214 to transfer the processing liquid to the intermediate roller 213 to the transferring point T3 of the drawing roller 215 to transfer the processing liquid to the intermediate roller 214, these present a relationship of L=A=D=E=F.

As a result, the portion placed at the application point R before feeding recording medium is caused to shift to the position directly underneath the discharge port Ha in the uppermost stream side even if the recording medium P is fed by the distance L in FIG. 15 after images are formed by use of the recording head H in the same procedure as in the case of the image formation apparatus described in conjunction with FIG. 10 to FIG. 12. Therefore, the jointed portion of processing liquid is not allowed to place in the recording area when the next image formation is operated. Further, the processing liquid on each of the transferring points T3, T2, and T1 is just placed at T2 and T1 on the recording medium P as the result of the feeding operation. Therefore, there is no difference in the elapsed time since the processing liquid has been applied, thus making it possible to uniform the surface density of the processing liquid.

Also, if each of the distances A, D, E, and F cannot be made equal to L in FIG. 15 due to the arrangement requirements of the apparatus, it may be possible to set them at A=m1×L, D=m2×L, E=m3×L, and F=m4×L (m1, m2, m3, and m4: integers). In this case, too, the jointed portion of the processing liquid is not allowed to be in the recording area and on each of the rollers 205, 213, and 214 when the next image formation is operated.

Also, if an apparatus is provided with means for feeding recording medium, which is capable of setting the amounts of feeding pitches of the recording medium at plural steps, the positional relationship is set as given below. For example, given the plural feeding amounts as K1, K2, and K3, and if three kinds of amounts of feeding pitches can be set at K1=L, K2=L/2, and K3=L/3, it should be good enough to define each of the distances A, D, E, and F in FIG. 15 as A=D=E=F=L in consideration of least common multiple of K1, K2, and K3.

At this juncture, it may be possible to define them as A=m1×L, D=m2×L, E=m3×L, and F=m4×L (m1, m2, m3, and m4: integers) as in the previous case. Meanwhile, the priority is given only to the three-pass recording of the high image quality mode due to restrictions or the like in spacewise, it may be possible to set them at A=D=E=F=L/3 or A=m1×L/3, D=m2×L/3, E=m3×L/3 and F=m4×L/3 (m1, m2, m3, and m4: integers).

Twelfth Embodiment

Figure 16:
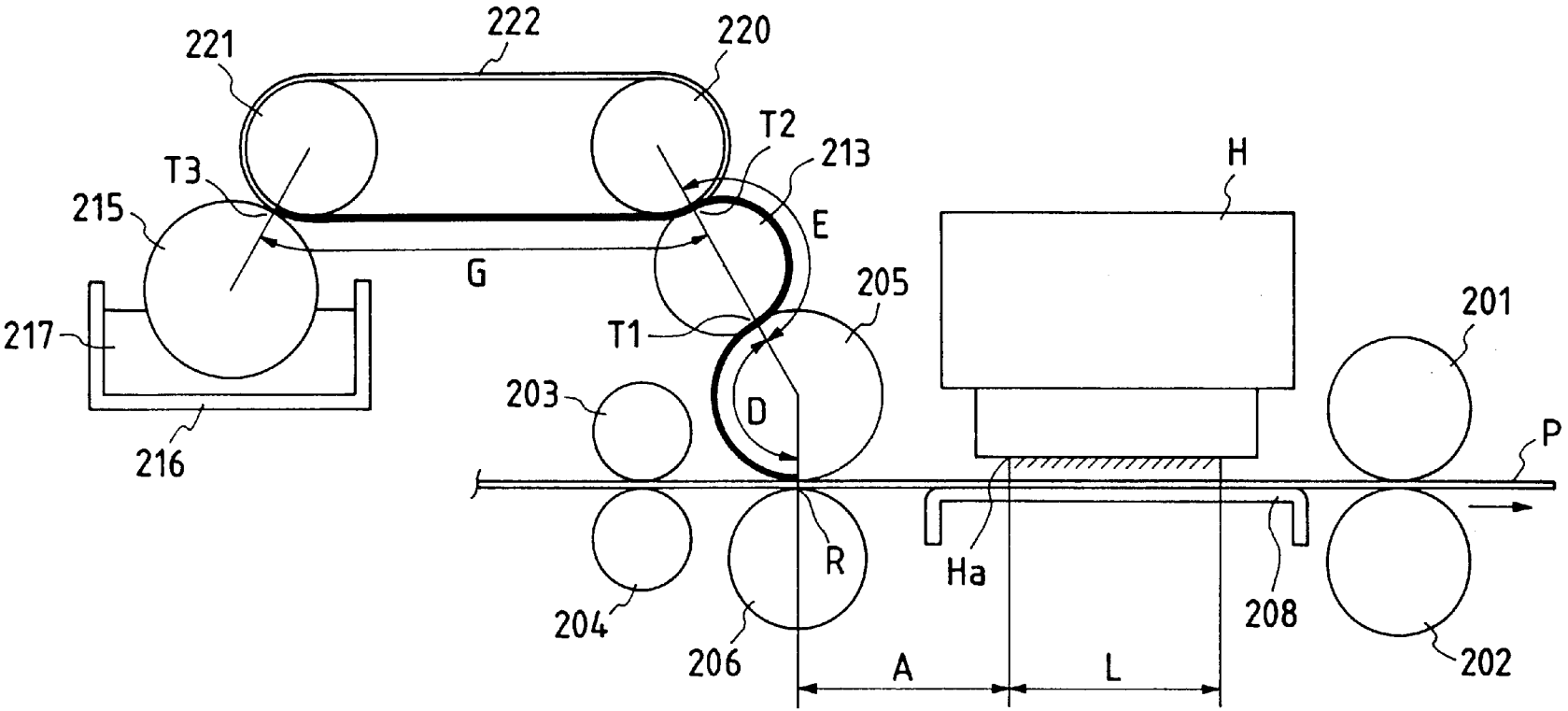
FIG. 16 is a vertically sectional view which schematically shows an image formation apparatus in accordance with a twelfth embodiment of the present invention.

FIG. 16 is a vertically sectional view which schematically shows an image formation apparatus in accordance with a twelfth embodiment of the present invention. The present embodiment is such that the relay roller 214 of the eleventh embodiment described in conjunction with FIG. 15 is replaced with a belt carrier means. This belt carrier means makes it easy to secure a carrying distance of a sufficient length. In FIG. 16, a bridging belt 222 is tensioned around a pair of rollers 220 and 221, which are rotatively supported in positions apart from each other by a given axial distance between them. This bridging belt 222 is tensioned appropriately by a mechanism (not shown).

The bridging belt 222 is arranged to be in contact with an intermediate roller 213 and a drawing roller 215. The positional relationship of the bridging belt 222 is given below. In other words, given L as the feeding amount of recording medium per feed (feeding pitch); and G, the distance on the bridging belt 222 (indicated by bold line in FIG. 16) from the transferring point T2 of the bridging belt 222 to transfer the processing liquid to the intermediate roller 213 to the transferring point T3 of the drawing roller 215 to transfer the processing liquid to the bridging belt 222, these present a relationship of G=2×L.

Therefore, even if the recording medium P is fed for a length L after images are recorded on the recording medium P by use of the recording head H in the same procedure as in the case of the image formation apparatus described in conjunction with FIG. 10 to FIG. 12, the jointed portion of the processing liquid is not placed in the recording area when the next image formation is operated because the portion on the recording medium P directly underneath the application point R is placed directly underneath the discharge port Ha on the uppermost stream side.

Further, the processing liquid on the transferring point T3 of the drawing roller 215 to transfer the processing liquid to the bridging belt 222 is in a state that it has been carried just to the mid point of the distance G between the transferring point T3 and the transferring point T2 of the bridging belt to transfer the processing liquid to the intermediate roller 213 because of the feeding operation of the recording medium P. Therefore, it is structured to allow such processing liquid to be at the transferring point T2 by the next feeding operation of the recording medium. Consequently, there is no difference in the elapsed time since the processing liquid has been applied, thus making it possible to uniform the surface density of the processing liquid. The twelfth embodiment represented in FIG. 16 differs from the eleventh embodiment in FIG. 15 in such aspects as described above. Any other points are essentially the same. Therefore, each of the corresponding members is designated by the same reference mark, and the description thereof will be omitted. With the same idea described for the eleventh embodiment represented in FIG. 15, it is possible to eliminate uneven application of the processing liquid. As a result, with the twelfth embodiment represented in FIG. 16, the same functional effects are obtainable as the eleventh embodiment described in conjunction with FIG. 15.

Thirteenth Embodiment

Figure 17:
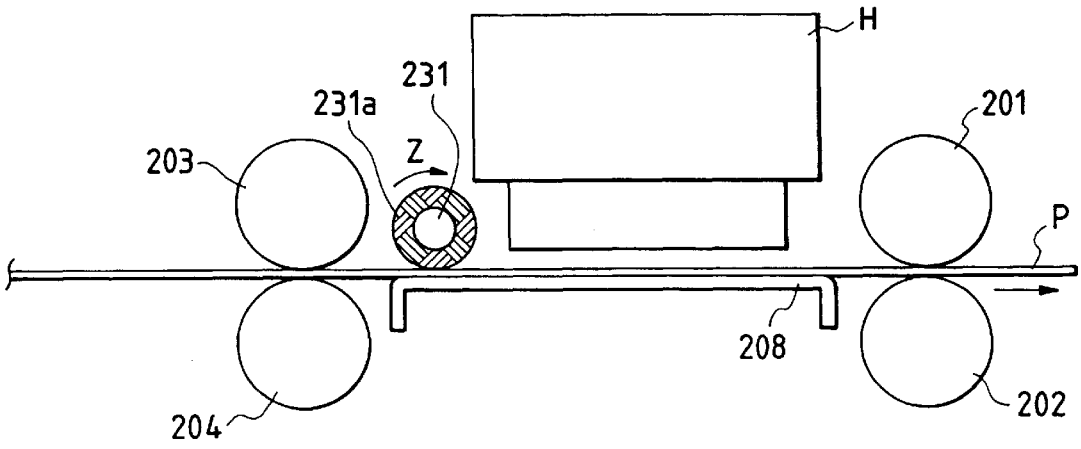
FIG. 17 is a vertically sectional view which schematically shows an image formation apparatus in accordance with a thirteenth embodiment of the present invention.

FIG. 17 is a vertically sectional view which schematically shows an image formation apparatus in accordance with a thirteenth embodiment of the present invention. In FIG. 17, a paper P, which is a recording medium, is pinched and fed by two feed roller pairs 201, 202, and 203, 204. Between the two roller pairs 201, 202, and 203, 204, an ink jet recording head H is supported by a mechanism (not shown: a carriage unit or the like) so that it can reciprocate in the direction perpendicular to the surface of FIG. 17.

Below the recording head H, a platen 208 is arranged to guide and hold the paper P. On the upstream side of the recording head H in the feeding direction of the recording medium. an impregnated transfer roller 231 provided with an impregnating unit 213*a* having processing liquid contained in it is axially and rotatively supported. This impregnated transfer roller 231 is arranged in such a manner to allow its impregnating unit 231*a* to be in contact with the recording surface of the recording medium P.

Here, when the recording medium (paper) P is fed to the right side in FIG. 17 by means of the two feed roller paris 201, 202, and 203, 204, the impregnated transfer roller 231 is driven to rotate in the direction opposite to the feeding direction of the recording medium P as indicated by an arrow Z. With the provision of such impregnated transfer roller 231, it is possible to apply processing liquid uniformly on the recording medium P, while preventing any lines from appearing on the recording medium P.

In this respect, the description has been made of the thirteenth embodiment represented in FIG. 17 by illustrating an impregnated transfer roller 231 as an example, means for applying processing liquid is not necessarily limited thereto. It may be possible to adopt each of the structures in accordance with the ninth to twelfth embodiments described in conjunction with FIG. 13 to FIG. 16. Also, in place of the impregnated transfer roller 231, it may be possible to arrange a structure so that a member like a belt having processing liquid impregnated on it is used for applying the processing liquid to a recording medium P or a member like a belt is used to transfer processing liquid to a transfer roller.

Fourteenth Embodiment

Now, hereunder, in accordance with fourteenth to seventeenth embodiments, the description will be made of an image formation apparatus capable of securing a sufficient amount of processing liquid at all times, and preventing the quality of recorded images from being degraded.

At first, using FIG. 18, the description will be made of an image formation apparatus in accordance with a fourteenth embodiment of the present invention.

A recording head 301 is detachably fixed to a carriage 302 together with an ink unit 303. The carriage 302 is fixed to a housing (not shown), and axially and movably supported by rails 305 and 306 that extend in the direction rectangular to the surface of FIG. 18. The tank unit 303 substantially comprises an ink storage 303*a* storing ink containing coloring agent in it, and a processing liquid storage 303*b* storing processing liquid in it. These storages 303*a* and 303*b* are structured to be exchangeable with respect to the carriage 303.

Figure 18:
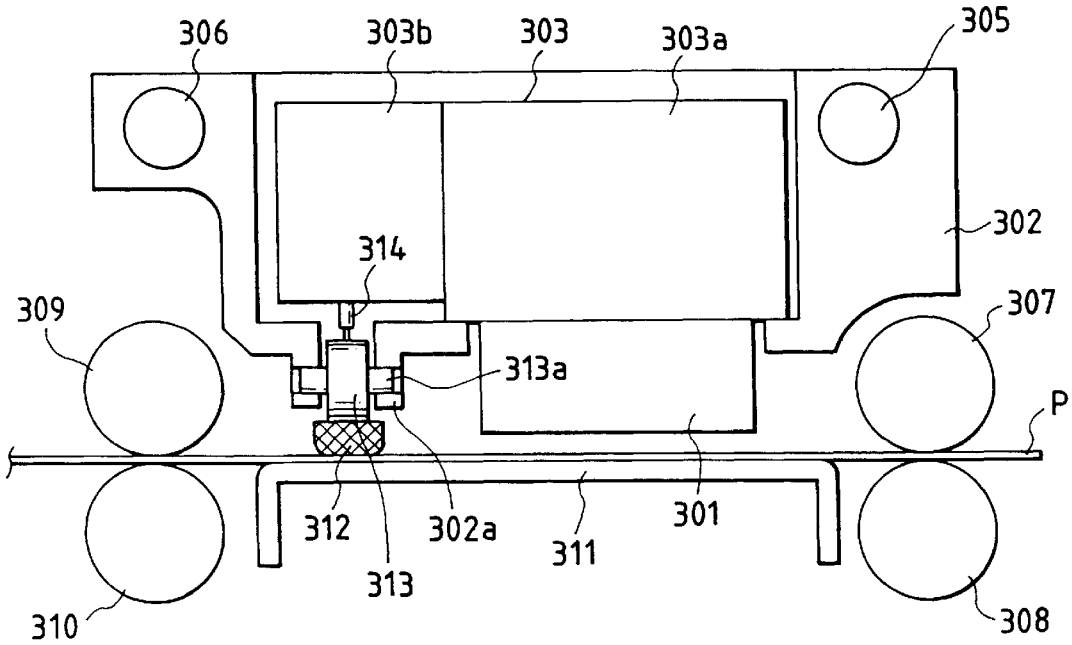
FIG. 18 is a cross-sectional view which shows the principal part of an image formation apparatus in accordance with a fourteenth embodiment of the present invention.

The recording medium P is pinched by two feed roller pairs 307, 308, and 309, 310 and fed from the left to right, observing it from the front side of FIG. 18. Below the processing liquid storage 303*b*, the transfer roller 313 is arranged with its shaft 313*a* is rotatively supported by the bearing 302*a* of the carriage 302. The processing liquid can drop onto the transfer roller 313 through a pipe 314 from the processing liquid storage 313*b*. In a housing (not shown), an application absorbent 312 is arranged in such a structure as to allow it to be in contact with the lower end of the transfer roller 313, and to be made movable up and downward, while being biased by pressure in the downward direction in FIG. 18. Below the recording head 301 and the application absorbent, a platen 311 is arranged to support the recording medium P.

Now, the description will be made of the operation of the image formation apparatus described above.

The recording medium P, which is carried to the feed roller pair 309 and 310 by means of a feeding mechanism (not shown), is cased to further advance in the right-hand direction in FIG. 18 by the driving force of the feed roller pair 309 and 310. When the recording medium P further advances in that direction, the recording medium P is pinched in between the application absorbent 312 impregnated with an appropriate amount of processing liquid, and the platen 311. Along feeding of the recording medium P, the processing liquid is being applied. At this juncture, if required, the carriage 302 is caused to scan in the direction perpendicular to the surface of FIG. 18 before feeding the recording medium P, and then, the processing liquid may be supplied to the application absorbent 312 through the transfer roller 313.

Further, the recording medium P is fed in the right-hand direction in FIG. 18. When it arrives at the position indicated in FIG. 18, the feeding thereof is suspended once. The carriage 302, which is on standby in a given position in the direction perpendicular to the surface of FIG. 18, is caused to scan in the direction toward the front and back side of FIG. 18. At the same time, the recording head 301 discharges ink at appropriate timing to form images in good condition, while the processing liquid and ink reacting upon each other on the recording medium P. At this juncture, by means of scanning operation of the carriage 302, the transfer roller 313 having the dropped-off processing liquid on it is driven to rotate on the application absorbent 312, thus the processing liquid being supplied to the application absorbent 312. This supply operation may be performed by arranging a valve mechanism between the pipe 314 in the carriage 302 and the transfer roller 313 in order to control the dropping off of the processing liquid.

Now, as the recording medium P is being fed in the right-hand direction in FIG. 18 by a distance equivalent to the recording width of the recording head 301, the recording liquid is applied to the recording medium P along the feeding thereof in the same procedure as described earlier.

By repeating the operation described above, images are formed on the entire surface of the recording medium while causing the processing liquid and ink to react upon each other thereon.

Fifteenth Embodiment

Now, using FIG. 19, the description will be made of an image formation apparatus in accordance with a fifteenth embodiment of the present invention.

The same reference marks are applied to the same constituents as those appearing in the fourteenth embodiment, and the description thereof will be omitted.

What differs in the present embodiment from the fourteenth embodiment are the structures of means for applying processing liquid and means for supplying it.

Below the processing liquid storage 303*b*, a porous absorbent 323 is arranged and fixed to the carriage 302. The processing liquid can be supplied from the processing liquid storage 303*b* through a pipe 314 inserted into this porous absorbent 323. Below the porous absorbent 323, a transfer roller 321 having a rubber portion 321*a* is arranged and fixed to a housing (not shown). Below the transfer roller 321, a pressure roller 322 is arranged, which is capable of pressing the transfer roller 321 to enable it to pinch the recording medium P.

Now, the operation of image formation will be described. The recording medium P, which is carried to the feed roller pair 309 and 310 by means of a feeding mechanism (not shown), advances in the right-hand direction by the driving force of the feed roller 309 and 310. When the recording medium P further advances in that direction, the recording medium P is pinched between the transfer roller 321 having the rubber portion 321*a* holding an appropriate amount of processing liquid on its surface, as well as by the pressure roller 322. Along the feeding of the recording medium P, the processing liquid is being applied to the recording medium P. At this juncture, if required, the carriage 302 is caused to scan in the front and back side directions of FIG. 19 before feeding the recording medium P, and the processing liquid may be supplied to the transfer roller 321 through the porous absorbent 323 fixed to the carriage 302.

Figure 19:
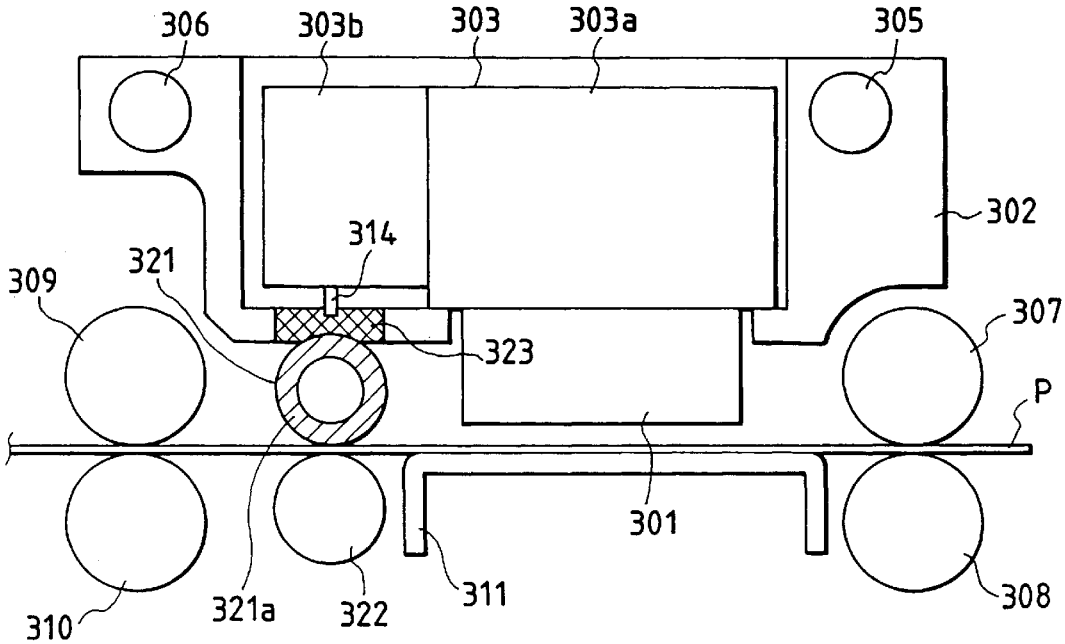
FIG. 19 is a cross-sectional view which shows the principal part of an image formation apparatus in accordance with a fifteenth embodiment of the present invention.

Further, when the recording medium P is fed in the right-hand direction in FIG. 19 to cause the leading end of the recording medium P to arrive at a position passing over the feed roller pair 307 and 308, the feeding operation is suspended once. Then, the carriage on standby in a given position in the front and back side directions of FIG. 19 is caused to scan in the direction perpendicular to the surface of FIG. 19, and at the same time, the recording head 301 discharges ink at appropriate timing to form images in good condition, while the processing liquid and ink reacting upon each other on the recording medium P.

Subsequently, the recording medium P is fed in the right-hand direction in FIG. 19 by a distance equivalent to the recording width of the recording head 301. Along this feeding, the processing liquid is being applied to the recording medium P in the same procedure as described earlier.

By repeating the operation described above, images are formed on the entire surface of the recording medium, while causing the processing liquid and ink to react upon each other thereon.

Sixteenth Embodiment

Figure 20:
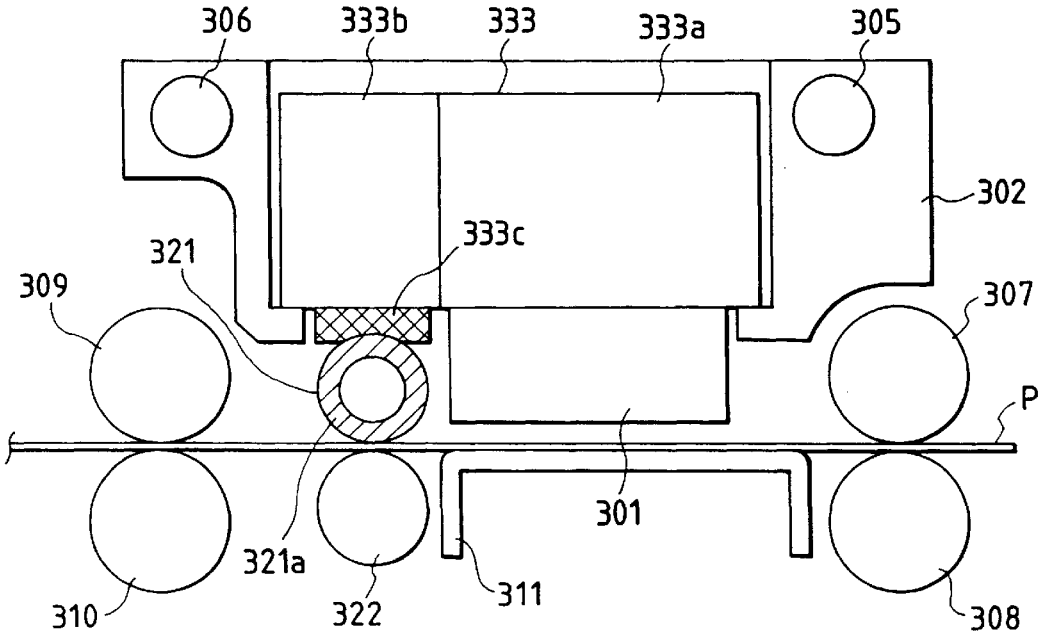
FIG. 20 is a cross-sectional view which shows the principal part of an image formation apparatus in accordance with a sixteenth embodiment of the present invention.

Now, using FIG. 20 the description will be made of an image formation apparatus in accordance with a sixteenth embodiment of the present invention.

The same reference marks are applied to the same constituents as those appearing in the fourteenth and fifteenth embodiments, and the description thereof will be omitted.

In the present embodiment, the application of processing liquid is executed by use of a transfer roller 325 similar to the one used for the fourteenth embodiment, but means for supplying processing liquid to the transfer roller 325 is different from the one used for the fourteenth embodiment.

The tank unit 333 comprises an ink tank storage 333*a* including coloring materials, and a processing liquid storage 333*b*, which are arranged to be exchangeable with respect to the carriage 302. Below the processing liquid storage 333*b*, a porous absorbent 333*c* is installed.

With the structure described above, the image formation is executed in the same manner as the fifteenth embodiment. At this juncture, the supply of processing liquid to the transfer roller 321 is conducted in such a manner that the porous absorbent 333*c* having an appropriate amount of processing liquid impregnated in it is in contact with the transfer roller 321 along the scanning operation of the carriage 302 in the direction perpendicular to the surface of FIG. 20.

Seventeenth Embodiment

Figure 21:
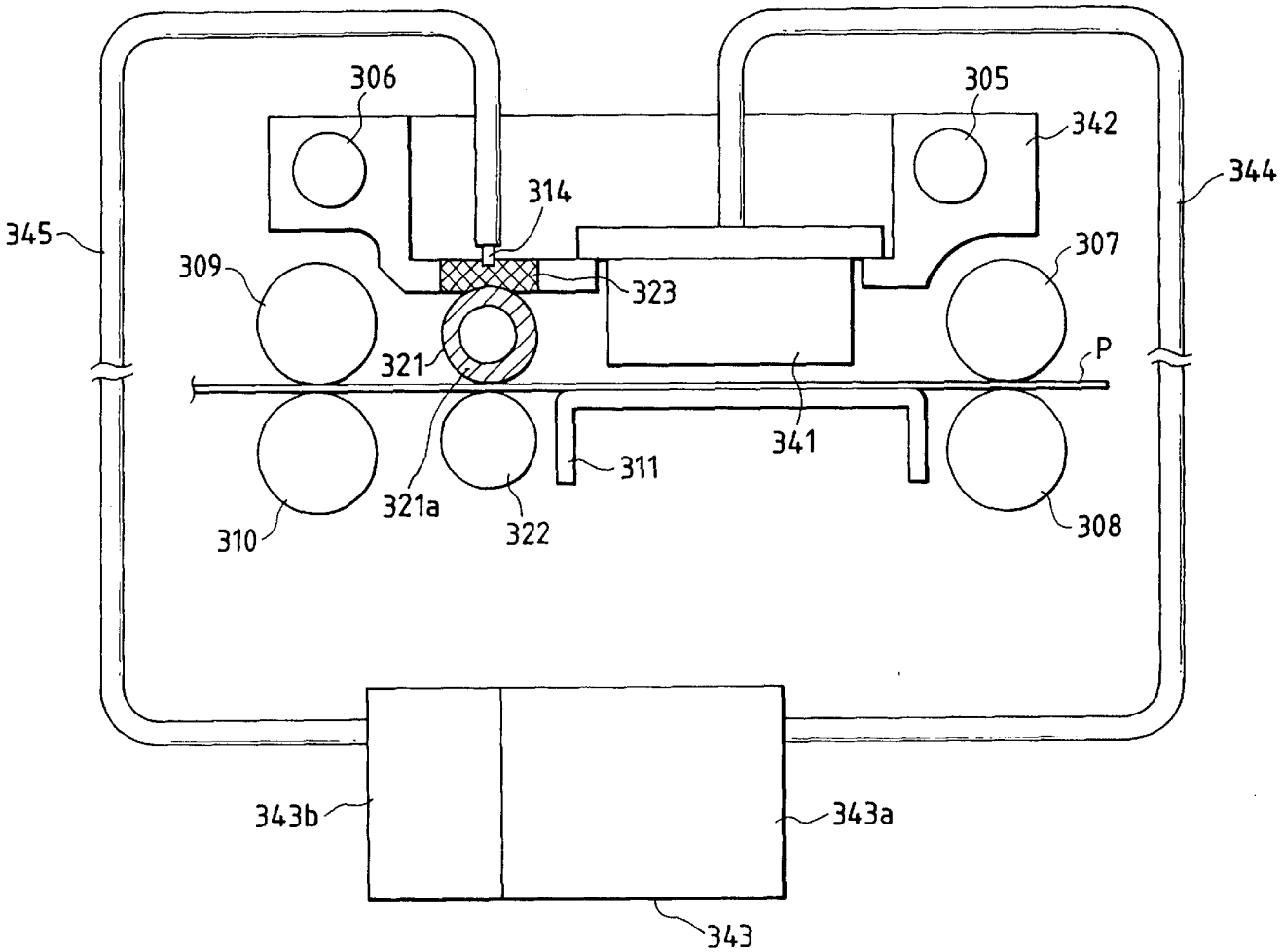
FIG. 21 is a cross-sectional view which shows the principal part of an image formation apparatus in accordance with a seventeenth embodiment of the present invention.

Now, using FIG. 21 the description will be made of an image formation apparatus in accordance with a seventeenth embodiment of the present invention.

The same reference marks are applied to the same constituents as those appearing in the fourteenth to sixteenth embodiments, and the description thereof will be omitted.

The present embodiment is characterized in that the arrangement of an ink tank unit 343 is different from the one arranged each for the fourteenth to sixteenth embodiments.

In other words, the tank unit 343, which comprises an ink storage 343*a* including coloring materials and a processing liquid storage 343*b*, is exchangeably arranged on a housing (not shown), and not on the carriage 342 as in the previous embodiments. Then, in order not to hinder the scanning operation of the carriage 342 and the feeding of recording medium P, tubes 344 and 345, which are drawn around in the interior of the housing, are arranged to connect each of the ink storage 343*a* and recording head 341, and the processing liquid storage 343*b* and a porous absorbent 323 fixed to the carriage 342. The procedure of image formation is the same as the one adopted for the fifteenth and sixteenth embodiments. In this case, the supply of processing liquid to the transfer roller 321 is such that the porous absorbent 333*c*, which is arranged below the processing liquid storage 333*b* and provided with an appropriate amount of processing liquid impregnated therein, is caused to be in contact with the transfer roller 321 along with the scanning operation of the carriage 302 in the direction perpendicular to the surface of FIG. 21. Also, the supply of processing liquid to the porous absorbent 333*c* is conducted in such a manner that the processing liquid is being dropped off from a pipe 314 from the processing liquid storage 343*b* through a tube 345.

A tank unit of the kind, which comprises an ink storage including coloring materials and a processing liquid storage, may be fixed to an appropriate position in the apparatus main body, but not necessarily on a carriage that performs scanning operation.

Also, in the embodiments described above, the supply of processing liquid is conducted along with the scanning operation of a carriage, but it may be possible to arrange an appropriate porous absorbent in the main body housing so as to allow it to face and contact with a transfer roller, and then, the processing liquid is supplied to such porous absorbent by use of a tube as in the embodiments described above.

Further, the tank unit comprising the ink storage including coloring materials and the processing liquid storage may be arranged to be exchangeable together with the recording head or to be exchangeable independent of the recording head. The present invention is effectively applicable to either events.

Here, for the embodiments described above, the description has been made of an apparatus by exemplifying a serial type where an ink jet recording head H travels in the main scanning direction, but the invention is equally applicable to a line type where by use of a line recording head having a length to cover partly or totally the entire width of a recording medium, recording is performed only by sub-scanning: here, the same effects are also attainable and obtainable. Moreover, for the embodiments described above, it is possible to use not only one recording head, but also, a plurality of recording heads to form color images and tonal images. Here, the present invention is equally applicable to obtain the same effects.

Also, for the present invention, it is possible to freely select the structures to arrange the recording head and ink tank by use of a head cartridge capable of exchanging a recording head integrally formed by an ink discharge unit and an ink retaining unit or by use of the separate ink head unit and ink tank, which are connected by means of an ink supply tube or the like, among other arrangements.

Figure 22:
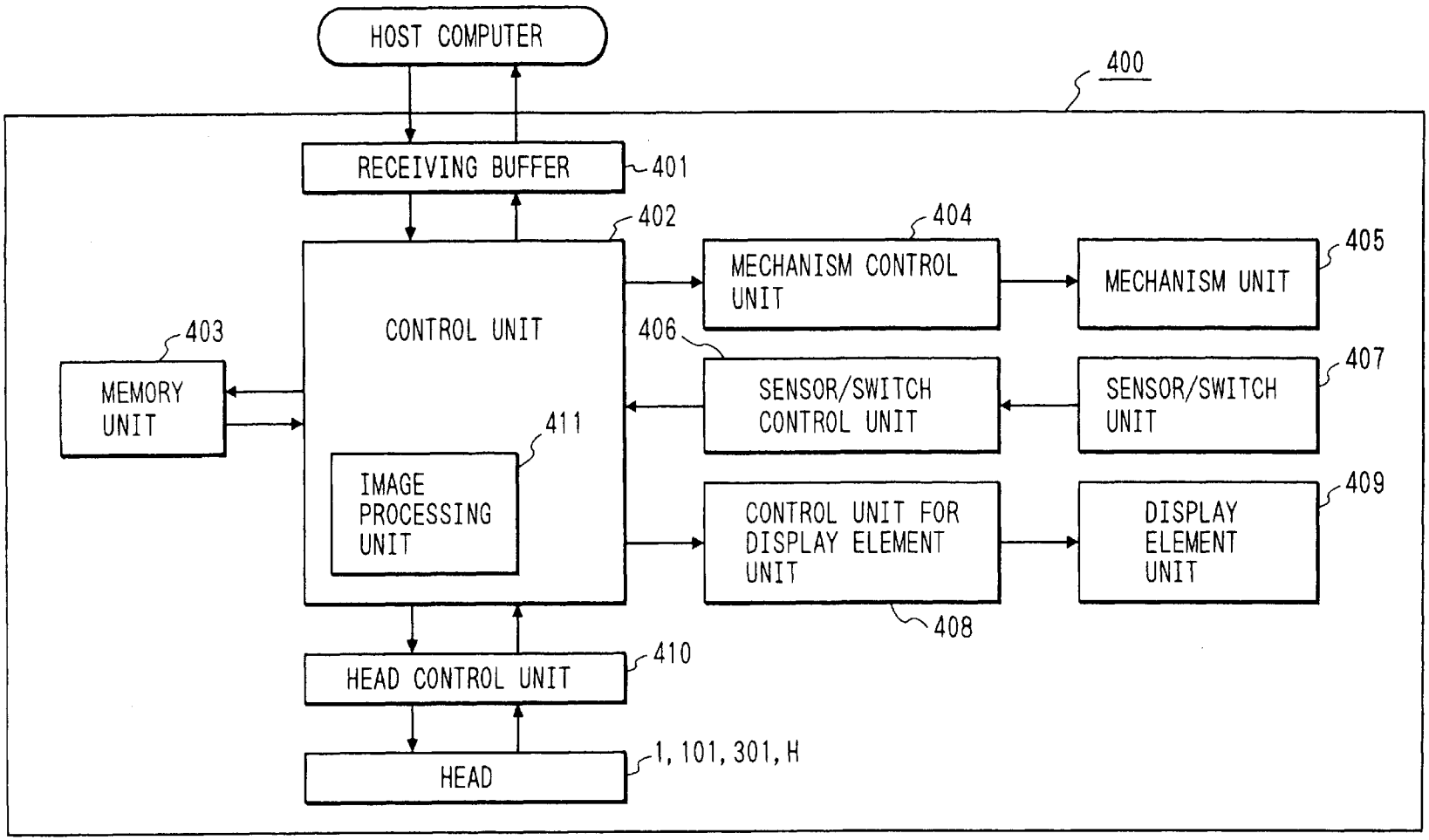
FIG. 22 is a block diagram which shows the controlling structure of n image formation apparatus embodying the present invention.

FIG. 22 is a block diagram which shows a controlling structure of an ink jet printing apparatus used as an image formation apparatus embodying the present invention. From a host computer, character and image data (hereinafter referred to as image data) to be printed are received in the receiving buffer 401 of an ink jet printing apparatus 400. Also, the data used to verify whether or not data are transferred exactly, as well as the data to notify the current operational status of the printing apparatus are transferred from the printing apparatus to the host computer. The data received in the receiving buffer 401 are transferred to a memory unit 403 of a RAM mode for the provisional storage under management of controller 402 having a CPU in it. A mechanism controller 404 drives the mechanical unit 405, such as a carriage motor, line feed motor, solenoid 114, which serve as driving sources of a carriage 102 (see FIG. 5), feed roller pairs 105, 106, and 107, 108, transfer roller 111, impregnated roller 112 (see FIG. 5), taking the fourth embodiment as an example. A sensor/SW controller 406 transmits to the controller 402 the signals from the sensor/SW unit 407 comprising various sensor and SWs (switches). An indication element controller 408 controls in accordance with instruction from the controller 402 the indication on an indication element unit 409 comprising, among others, LED, liquid crystal display elements of the display panel group. A head controller 410 controls the recording head 101 individually in accordance with instructions from the controller 402. Also, this controller informs a reading controller 402 of temperature and other conditions that indicate the current status of each head.

For the controller 402, an image processing unit 411 is arranged to perform image processing to be described later in conjunction with FIG. 23 and FIG. 24.

Figure 23:
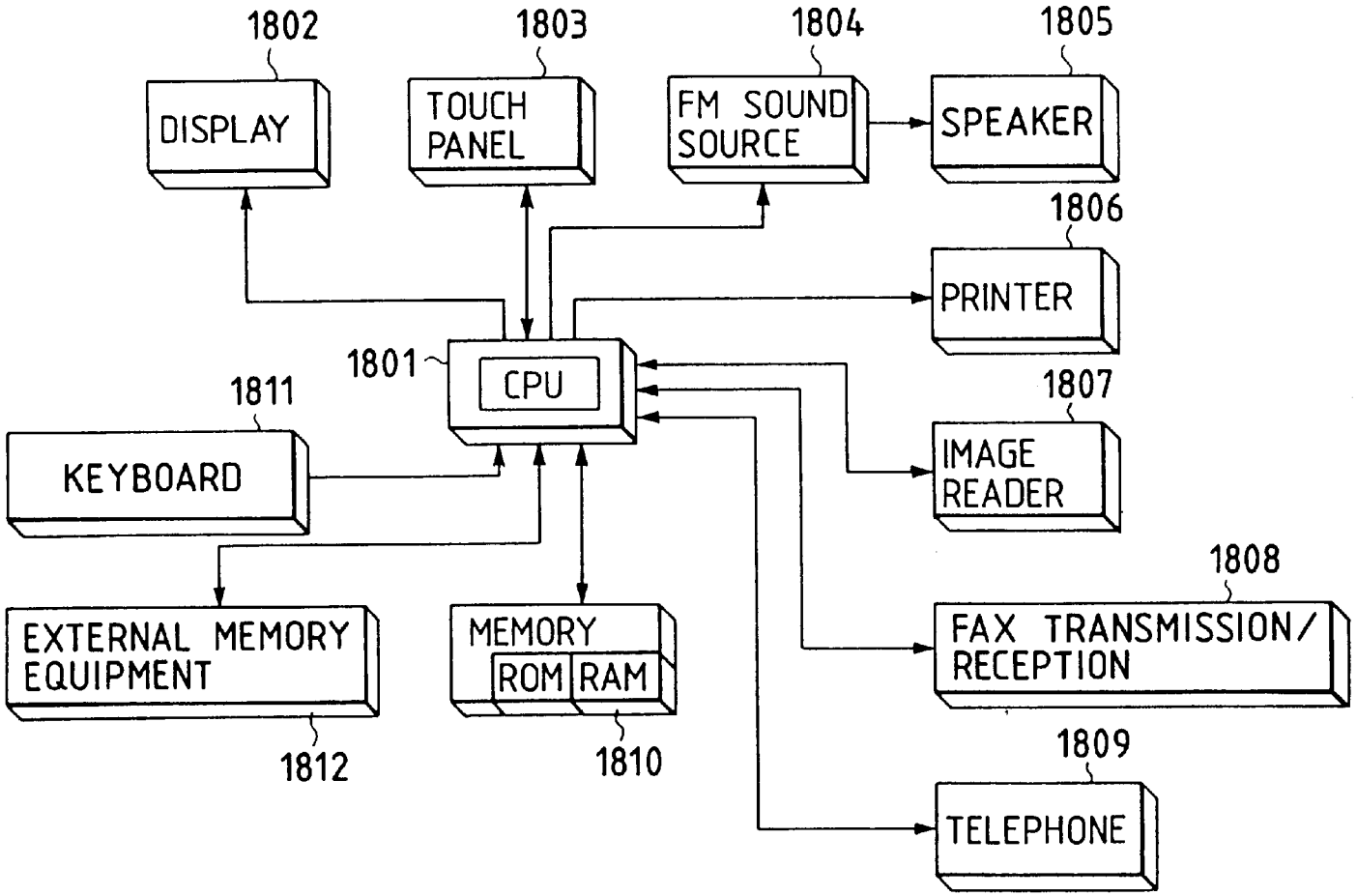
FIG. 23 is a block diagram which shows one example of an information processing system using an image formation apparatus embodying the present invention.

FIG. 23 is a block diagram which schematically shows the structure where a printing apparatus of the present invention is applied to an information processing apparatus that function as word processor, personal computer, facsimile apparatus, and copying machine.

In FIG. 23, a reference numeral 1801 designates a controller to control the entire system of an apparatus. The controller is provided with a CPU such as a microprocessor, and various I/O ports to output control signals, data signals, and others to each unit or receive control signals and data signals from each unit to execute controlling as required; 1802, a display unit to indicate on its screen various menu and document information, as well as image data and the like read by an image reader 180; and 1803, a pressure-sensitive transparent touch panel arranged on the display unit 1802, which makes it possible to input items, coordinated positions, and the like on the display unit 1802 when depressing the surface thereof by use of finger or the like.

A reference numeral 1804 designates an FM (Frequency Modulation) sound source to store musical information prepared by a music editor or the like in the memory unit 1810 or external storage 1812 as digital data, and then, perform FM modulation by reading such data from the storage or the like. The electrical signals from the FM sound source is transformed into audible sounds by use of a speaker unit 1805. The printer unit 1806 serves as output terminal of a word processor, personal computer, facsimile apparatus, and copying machine, to which the printing apparatus of the present invention is applicable.

A reference numeral 1807 designates an image reading unit that inputs data by reading them from a source document optoelectrically. This unit is arranged on the way of feeding passage of the source document to read a source document for facsimile and copying operations; 1806, a transmission and reception unit of facsimile (FAX) to execute facsimile transmission of the data read from its source document by means of the image reader unit 1807, and also, to receive the facsimile signals and demodulate them: this unit is provided with an interface function to communicate with the external equipment; and 1809, a telephone unit having various telephone functions such as regular and answering ones.

A reference numeral 1810 designates the memory unit including ROM that stores system program, manager program, and other application programs, and character fonts and dictionary as well; RAM that stores application program and document information loaded from the external storage 1812; and also, video RAM.

A reference numeral 1811 designates a key board unit to input document information, various commands, and the like.

A reference numeral 1812 designates an external storage using a floppy disc, hard disc or the like as storing medium. In this external storage 1812, document information, music or voice information, user's application program and the like are stored.

Figure 24:
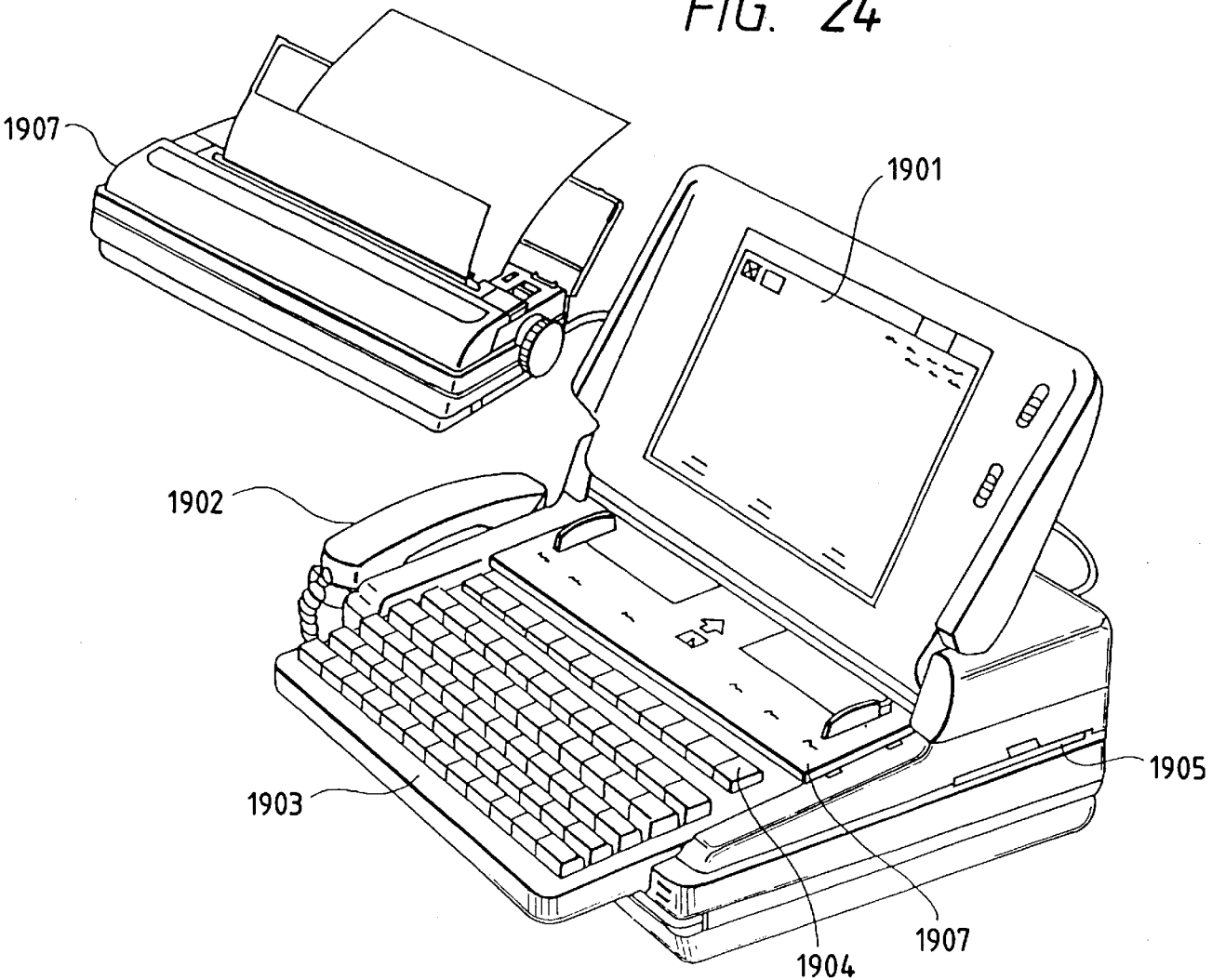
FIG. 24 is a perspective view which shows the external appearance of an information processing system using an image formation apparatus embodying the present invention.

FIG. 24 is a view which schematically shows the external appearance of an information processing apparatus represented in FIG. 23.

In FIG. 24, a reference numeral 1901 designates a flat panel display using liquid crystal and others to indicate various menu, graphic information, document information, and the like. On this display 1901, a touch panel 1803 is provided, and by depressing the surface thereof with a finger or the like, it is possible to input coordinates and specific items. A reference numeral 1902 designates a hand set to be used when the apparatus functions as a telephone device. The key board 1903 is connected to the main body through a detachable code to input various document information and data. Also, on this key board 1903, various functional keys are provided. A reference numeral 1905 designates an insertion slot for a floppy disc to communicate with the external storage 1812.

A reference numeral 1906 designates a sheet stacker to stack source documents to be read by the image reader 1807. Each document that has been read is exhausted from behind the apparatus. Also, the facsimile reception or the like is printed out by use of an ink jet printer 1907.

In this respect, the display unit 1802 can be a CRT, but it is desirable to use a flat panel liquid crystal display or the like fabricated by utilizing ferroelectric liquid crystal. Then it is possible to make the display light in addition to making it thinner.

When the information processing apparatus described above is used to function as a personal computer or a word processor, each kind of information inputted through the key board unit 1811 is processed by means of the controller 1801 in accordance with the specific program and output to the printer unit 1806 as images.

When the apparatus functions as a receiver for a facsimile apparatus, facsimile information inputted from the FAX transmission and reception unit 1808 through communication line is given a reception process by means of the controller 1801 in accordance with the specific program and output to the printer unit 1806 as received images.

Also, when the apparatus functions as a copying machine, the source document is read by the image reader 1807, and the data read from the source document are outputted to the printer unit 1806 as copying images through the controller 1801. In this respect, when it functions as the transmitter for the facsimile apparatus, the data read by the image reader 1807 from the source document is given a transmission process by the controller 1801 in accordance with the specific program, and then, send out to the communication line through the FAX transmission unit 1808.

Figure 25:
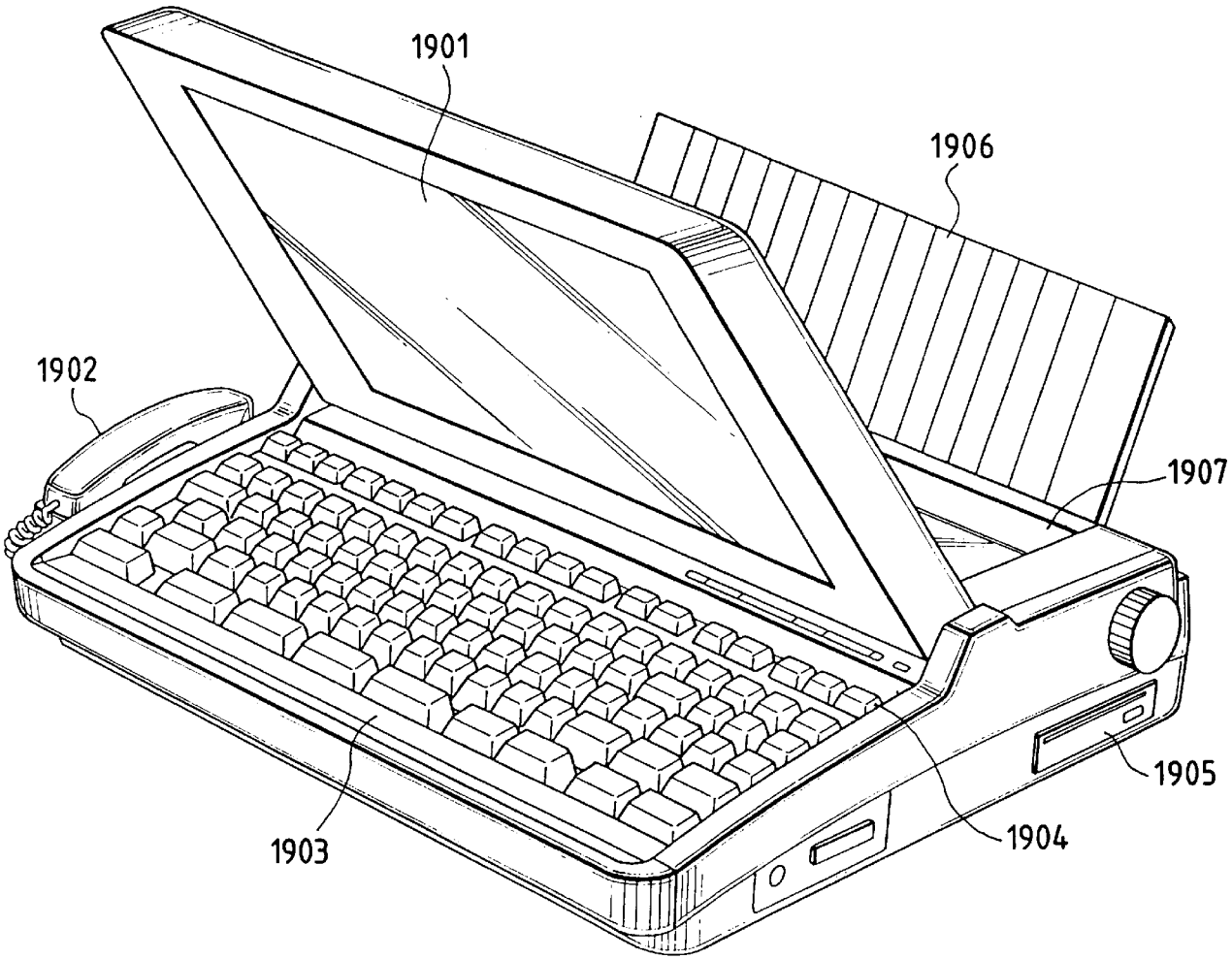
FIG. 25 is an external view which shows another example of the information processing system using an image formation apparatus embodying the present invention.

In this respect, it may be possible to make the information processing apparatus an integral type by incorporating an ink jet printer in it as shown in FIG. 25. In this case, its portability can be enhanced. In FIG. 25, the members having the same function as those represented in FIG. 24 are designated by the corresponding reference marks.

With the application of a printing apparatus of the present invention to the multiple function type information processing apparatus described above, printed images can be obtained in high quality at higher speed with lesser noises. Therefore, it is possible to enhance the functions of the information processing apparatus still more.

As described above, in accordance with the embodiments of the present invention, an image formation apparatus having application means for applying processing liquid while causing such means to be in contact with a recording medium makes it possible to apply the processing liquid efficiently in a quantity as required. Therefore, the image formation apparatus that does not hinder any attempt to make it smaller can be provided. In other words, by mounting means for applying processing liquid on a carriage, it becomes possible to apply the processing liquid only on the recording surface of the recording medium because the application thereof can be interlocked with the relative movement of the carriage with respect to the recording medium. As a result, the present invention demonstrates such effect that the processing liquid is prevented from being wastefully consumed by allowing it to be drawn around to the back side of a recording medium or it is prevented from being retransferred to a platen to present causes of stains together with ink mist. Also, the length of roller to be used can be almost the same as the width of a recording head to be adopted. Hence there is an effect that the apparatus can be made smaller.

Further, it becomes possible to arrange means for applying processing liquid with a better space efficiency by locating it between an ink tank and a recording medium in addition to the structure described above.

Also, the aforesaid application means can be located in a carriage in a position corresponding to the recordable area of the ink jet recording head in the sub-scanning direction in which a recording medium is fed or located in a position on the upstream side of the ink jet recording head in the main scanning direction in which the image formation advances, or in a carriage in a corresponding to the recordable area of an ink jet recording head in the sub-scanning direction and in positions on both outer sides of a plurality of ink jet recording head groups in the main scanning direction.

In this way, it becomes possible to make the required time shorter from the application of processing liquid to the recording operation by use of ink containing coloring materials. Therefore, it is possible to minimize the subsidence of the processing liquid to keep effective processing component remaining on the surface of a recording medium as much as possible, thus obtaining good quality for recorded images.

Also, the aforesaid application means can be located in a carriage in a position on the upstream side of an ink jet recording head in the sub-scanning direction and in a position almost corresponding to the ink jet recording head of plural ink jet recording head on the lowermost stream side in the image formation direction of the recording medium in the main scanning direction. In this way, it is possible to minimize the application range of the processing liquid with respect to the recording medium even when the width of such recording medium is smaller than a recording medium having the maximum recordable width for an image formation apparatus to be used. Therefore, any wasteful consumption of processing liquid can be prevented. At the same time, there is an effect that any stains can be prevented, which may be brought about by the processing liquid to be applied to a range more than the width of a platen used for a specific recording.

Further, the supply of processing liquid to its application means can be made from a processing liquid storage mounted on a carriage. Therefore, it is possible to make the operating system of such supply compactly.

Also, the supply of processing liquid to means for applying the processing liquid can be performed by contacting a processing liquid storage fixed in an image formation with means for supplying the processing liquid. Therefore, a large quantity of processing liquid can be stored in advance, thus making it possible to reduce the frequency of its supply significantly. In this way, the operativity can be enhanced.

In addition, the length of the contacting portion of means for applying processing liquid in the feeding direction of a recording medium can be made integral times the recording width of an ink jet recording head or the length of the contacting portion of means for applying processing liquid in the feeding direction of a recording medium can be made integral times any one of plural feeding amounts of a recording medium at the time of forming images. In this way, it is possible to make the distribution density of the processing liquid constant in the area of recording by ink per main scanning of the ink jet recording head. Therefore, the reaction between the processing liquid and ink takes place without any unevenness in the recording area, hence obtaining recorded images in good quality. Also, the distance from the nozzles on the lowermost stream side of the nozzle array of an ink jet recording head in the feeding direction of a recording medium to the application point on the uppermost stream side of the application area of means for applying processing liquid in the feeding direction of the recording medium can be made integral times the recording width of the ink jet recording head or the distance from the nozzle on the lowermost stream side of the nozzles array of an ink jet recording head in the feeding direction of a recording medium to the application point on the uppermost stream side in the application area of means for applying processing liquid in the feeding direction of the recording medium can be made integral times any one of plural feeding amounts of the recording medium at the time of forming images. In this way, it is possible to make the temporal gap constant between the application of the processing liquid and the recording operation by use of ink for any one of the main scanning operations of the carriage. Therefore, permeation level of the processing liquid into the recording medium becomes even, thus making it possible to execute the reaction between the processing liquid and ink for the provision of recording images in good quality.

Furthermore, it is possible to selectively set means for applying processing liquid in contact with or apart from a recording medium. Therefore, if a recording medium is a kind that does not match with the processing liquid to be used, the application thereof can be suspended or if any defective feeding of a recording medium takes place, that is, the so-called jamming occurs, the application means can be separated from the recording medium to make it easy to remove the recording medium, and to effectively enhance the operativity.

Also, by arranging to selectively set means for applying processing liquid to be in contact with or apart from a recording medium or selectively set an image formation apparatus provided with supply means for supplying processing liquid to such application means to operate or suspend its supplying function with respect to such the application means. In this way, it is possible to apply an appropriate amount of processing liquid as required, and maintain good image quality for many kinds of recording media. At the same time, there is an effect that any adhesion of processing liquid to the portion other than the recording medium can be prevented to avoid any occurrence of related troubles, and to implement saving the consumption of the processing liquid.

In other words, in accordance with the kinds of recording media, the contacting and detaching mode of means for applying processing liquid with respect to a recording medium or the operating and suspending mode of the supplying function of supply means with respect to application means is selectively set. Thus, if a recording medium to be used is an OHP sheet or the so called coated paper having an ink receiving layer already on its base material, and images to be formed on such medium are likely to be degraded by the additional application of the processing liquid, a measure can be taken to detach means for applying processing liquid from such recording medium. In this way, it is possible to effectively maintain good quality of images on many kinds of recording media.

Also, it is possible to arrange that means for applying processing liquid is in contact with a recording medium or supply means is allowed to supply processing liquid to application means only when the recording medium is inserted in the portion where means for supplying processing liquid is in contact with the recording medium. In this way, the application or supply is not allowed to be operated without any recording medium in the processing liquid application unit in such event as idle rotation when feeding or exhausting a recording medium. Therefore, no excessive processing liquid is applied to the platen unit installed below the application unit. There is no possibility that contaminated ink mist adheres to the platen, and that any stains are transferred again to the processing liquid application unit, thus making it possible to prevent any possible stains from adhering to the recording medium. Further, there is an effect that the volume of processing liquid can be prevented from becoming short of the quantity to cover an anticipated number of sheets to be recorded.

Further, it is made possible to arrange that means for applying processing liquid is in contact with a recording medium for the application of the processing liquid or supply means is allowed to supply processing liquid to application means only when the recording medium is inserted into the portion where means for applying processing liquid is in contact with the recording medium, and also, only at the time of feeding the recording medium. Then, when the apparatus is used as a printer for a computer, there is no possibility that any excessive amount of processing liquid is applied to a recording medium even when it may take a long time to transfer data between the computer and printer while an image formation is still in progress, and there should occur a long time interruption of the image formation, because during such period, means for applying processing liquid is detached from the recording medium. As a result, it is possible to prevent any image disturbance due to the excessive application of the processing liquid or prevent effectively the volume of the processing liquid from becoming short of the quantity to cover an anticipated number of sheets to be recorded.

In addition, should any defective feed of a recording medium occurs, it is possible to detach means for applying processing liquid from the recording medium. Therefore, the recording medium can be removed easily. There is no possibility that the processing liquid is applied wastefully.

Also, it is possible to provide a carriage capable of traveling with at least one recording head mounted thereon, and then, means for applying processing liquid is allowed to be in contact with a recording medium only in a specific position of the carriage, but it is detached from the recording medium in any other positions. In this way, with a simple structure, the contacting and detaching mode of means for applying processing liquid can be arranged with respect to the recording medium.

Moreover, by setting such specific position of the carriage where means for applying processing liquid is allowed to be in contact with the recording medium outside the carriage traveling range at the time of image formation, it is possible to avoid applying any excessive amount of processing liquid to the recording medium reliably, because means for applying processing liquid does not abut upon the recording medium at all while the carriage is in the operation of forming images.

Also, even when there is difference in the degree of permeation of processing liquid on a recording medium due to difference in the elapsed time since the processing liquid has been applied to the locations before and after the jointed portion thereof on the surface of the recording medium, it is possible to prevent such jointed portion from being placed in the area on the recording medium where recording is to be made in each of the recording modes, and also, in a high image quality mode where the recording medium is fed at the minimum pitch. Therefore, the surface density of effective component to cohere the coloring materials in ink can be made uniform on the surface of the recording medium, thus providing an image formation apparatus capable of obtaining uniform images without any unevenness in them.

Also, even if difference occurs in the surface density of processing liquid due to difference in the elapsed time since the processing liquid has been applied to the locations before and after the jointed portion of the processing liquid within the range of means for carrying processing liquid to the application point of means for applying processing liquid to the recording medium, it is possible to prevent such jointed portion of processing liquid from placing in the area to be recorded on the surface of the recording medium at the time of recording in any one of regular recording modes, and also, in a high image quality mode where the minimum feeding pitch is adopted. In this way, the surface density of effective component is made uniform to cohere the coloring materials in ink on the surface of the recording medium, thus stabilizing the degree of cohesion of the coloring materials to provide an image formation apparatus capable of obtaining uniform images without any unevenness in them. Also, the structure is arranged so that the rotational direction of means for applying processing liquid, which applies the processing liquid to the portion on the recording medium before any recording while causing this means to be rotatively in contact therewith, is made opposite to the direction in which the recording medium is fed. Therefore, it is possible to provide difference in the relative speed of the recording medium and application means so as to prevent the processing liquid from being applied unevenly to the recording medium, and at the same time, to provide an image formation apparatus capable of providing back tension to the recording medium, thus minimizing the creation of lines on the recording medium.

Also, it is made possible for the operator of the apparatus to replace processing liquid at the same time of exchanging tanks following the shortage of ink containing coloring materials. As a result, the processing liquid is always secured sufficiently, thus preventing images from being degraded due to the shortage of processing liquid.

Also, with this arrangement, there is no need for the provision of any sensor dedicated to detecting the remains of processing liquid in order to let the operator of the apparatus recognize the shortage thereof. Therefore, the apparatus can be made smaller. At the same time, the operator is not necessarily informed of the remains of the processing liquid, thus making it possible to effectively enhance the operativity of the apparatus thus arranged.

What is claimed is:

1. An image forming apparatus for forming an image on a recording medium, said apparatus comprising:

a head mounting portion for mounting an ink jet recording head for discharging ink liquid having a coloring material from an ink discharge port;

a process liquid storing member for storing a process liquid for condensing the coloring material in the ink liquid;

a process liquid supply roller arranged immersibly in the process liquid stored in said process liquid storing member, wherein said process liquid supply roller does not contact a recording surface of the recording medium; and a process liquid coating roller for coating the recording surface of the recording medium with the process liquid stored in said process liquid storing member and supplied through said process liquid supply roller, said process liquid coating roller being provided so that a peripheral surface of said process liquid coating roller is contactable with the recording surface of the recording medium upstream of a conveyance direction of the recording medium with respect to said head mounting portion.

2. An image forming apparatus according to claim 1, wherein a process liquid supply route for supplying the process liquid held on a peripheral surface of said process liquid supply roller to the peripheral surface of said process liquid coating roller is provided between said rollers.

3. An image forming apparatus according to claim 2, wherein said process liquid supply route includes a peripheral surface of an intermediate roller disposed between said process liquid supply roller and said process liquid coating roller.

4. An image forming apparatus according to any of claims 1 to 3, wherein said ink jet recording head has an electrothermal converting element for generating energy utilized to discharge ink liquid.

5. An image forming apparatus according to claim 2 or 3, wherein said process liquid supply route is provided between said process liquid supply roller and said process liquid coating roller and includes an outer peripheral surface bridged over said two rollers.

6. An image forming apparatus according to claim 5, wherein said ink jet recording head has an electrothermal converting element for generating energy utilized to discharge ink liquid.

7. An image forming apparatus according to claim 1, wherein said process liquid coating roller is not immersibly arranged in the process liquid stored in said process liquid storing member.

* * * * *